US009533427B1

(12) United States Patent
Heintzelman, Jr. et al.

(10) Patent No.: US 9,533,427 B1
(45) Date of Patent: Jan. 3, 2017

(54) CORRUGATED SAMPLE CUTTER

(71) Applicant: Testing Machines, Inc., New Castle, DE (US)

(72) Inventors: Dale Lee Heintzelman, Jr., Bear, DE (US); John Louis Sullivan, Wilmington, DE (US)

(73) Assignee: TMI Holdco, Inc., Boston, MA (US)

( * ) Notice: Subject to any disclaimer, the term of this patent is extended or adjusted under 35 U.S.C. 154(b) by 493 days.

(21) Appl. No.: 13/860,171

(22) Filed: Apr. 10, 2013

(51) Int. Cl.
*B26D 7/26* (2006.01)
*B26D 1/11* (2006.01)
*B26D 7/01* (2006.01)

(52) U.S. Cl.
CPC ..... *B26D 7/26* (2013.01); *B26D 1/115* (2013.01); *B26D 7/015* (2013.01)

(58) Field of Classification Search
CPC ..... B26D 7/26; B26D 7/2642; B26D 7/2657; B26D 7/2628; B26D 7/265; B26D 1/115; B26D 7/015; B26D 7/2621; B26D 7/2614; B26D 7/2635; B26D 2007/2607; B26D 2007/2657; Y10T 83/8716; Y10T 83/7738; Y10T 83/7743; Y10T 83/8828; Y10T 83/8822; Y10T 83/8831; Y10T 83/7507; Y10T 83/0311; Y10T 83/0363
USPC ..... 30/173, 446, 152, 503.5
See application file for complete search history.

(56) References Cited

U.S. PATENT DOCUMENTS 782,121 A * 2/1905 Foreman ..... B23D 49/003 30/503.5
1,432,072 A * 10/1922 Lodge ..... B23D 49/11 30/503.5
3,130,622 A * 4/1964 Eno ..... B26F 1/3853 83/382
3,496,817 A * 2/1970 Staats ..... B26D 1/205 83/451
3,779,119 A * 12/1973 Broides ..... B26F 1/3853 83/455
3,791,247 A * 2/1974 Pretz ..... B26D 1/151 83/418

(Continued)

FOREIGN PATENT DOCUMENTS

CN 203031651 * 12/2012

OTHER PUBLICATIONS

Hardware House 64-4567 Contractor Pack Roller Catch, Brown, 10-Pack, date first available Mar. 1, 2010, Amazon.com, available at: http://www.amazon.com/Hardware-House-64-4567-Contractor-10-Pack/dp/B002BY9JT6/ref=sr_1_1?ie=UTF8&qid=1442684527&sr=8-1&keywords=hardware+house+64-4567.*

(Continued)

*Primary Examiner* — Jonathan Riley
(74) *Attorney, Agent, or Firm* — Harrity & Harrity, LLP

(57) ABSTRACT

A sample cutter includes a base plate for supporting a corrugated sample to be cut, and a pair of guide rails connected to the base plate. The pair of guide rails enable the corrugated sample to be positioned for cutting. The sample cutter also includes a slide rail connected to the base plate, and a cutting assembly connected to the slide rail. The cutting assembly is capable of moving along a length of the slide rail. The cutting assembly includes a pair of cutting blades that are capable of being spaced apart at a plurality of widths with respect to each other, and cutting the corrugated sample based on the plurality of widths.

21 Claims, 17 Drawing Sheets

(56) References Cited

U.S. PATENT DOCUMENTS

| | | | | | |
|---|---|---|---|---|---|
| 3,964,360 | A * | 6/1976 | Schwartz | B26F 1/3853 | 83/464 |
| 4,249,437 | A * | 2/1981 | Hagenson | B26D 5/04 | 83/364 |
| 4,379,419 | A * | 4/1983 | Woock | B23D 45/027 | 33/437 |
| 5,146,823 | A | 9/1992 | Holmes | | |
| 5,303,626 | A * | 4/1994 | Uehara | B26D 1/205 | 83/451 |
| 5,309,642 | A * | 5/1994 | McGinnis | B26B 29/06 | 33/32.2 |
| 5,322,001 | A * | 6/1994 | Boda | B23D 35/008 | 83/455 |
| 5,325,752 | A * | 7/1994 | Bory | B26D 1/045 | 83/468.4 |
| 5,408,909 | A * | 4/1995 | Suk | B26D 1/045 | 83/467.1 |
| 5,423,238 | A * | 6/1995 | Bory | B26D 1/045 | 269/47 |
| 5,537,904 | A * | 7/1996 | Albin | B26F 1/3853 | 83/455 |
| 7,424,780 | B2 * | 9/2008 | Cicchitti | A61F 5/445 | 30/310 |
| 2002/0069736 | A1 * | 6/2002 | Yasoda | B26D 3/085 | 83/62.1 |

OTHER PUBLICATIONS

Kahn, Bill, Advanced Adhesives Report, Nov. 2010, avaialbe, on Apr. 13, 2016, at : http://harperlove.com/PDF/NewsNovember10.pdf.*

* cited by examiner

500

500

500

CORRUGATED SAMPLE CUTTER

BACKGROUND

Corrugated cardboard is commonly used in the manufacture of shipping cartons with a wide variety of uses. In the manufacture of corrugated cartons, it is customary to determine the compression strength of the corrugated carton by edge crush testing of precision cut samples that are typically of square or rectangular dimensions. The square or rectangular samples are designed to be subjected to several different tests, including an edgewise compression test that should be performed precisely parallel to a direction of internal flutes of the samples or precisely normal to a flute direction. To be able to produce reproducible test results on similarly constructed corrugated samples, it is necessary that the square or rectangular samples be uniformly and precisely cut so that two of the sample edges are precisely parallel to the flutes, and the other two sample edges are precisely normal to the flutes.

The samples may be cut by hand, such as with a razor, knife, or saw, or may be formed with a die. However, such methods are unreliable since the cut, and the precision of the cut, varies with the manual skill of the cutter. If a resulting cut is not square (e.g., the edges are not parallel or the cut edge is beveled), it is difficult to conduct a reliable crush test.

Some corrugated sample cutters provide more precise cuts than the aforementioned methods. Such cutters may include a base plate and a pair of cutting blades that are slidably mounted to the base plate with a slide block and rail system for cutting movement in a direction parallel to a first guide rail. Second guide rails are spaced from each other by a predetermined distance to allow a sample to be simultaneously cut by the pair of cutting blades. After cutting the sample a first time, the sample may include first and second cut edges, and the sample may be rotated ninety degrees and positioned between the pair of second guide rails. The pair of cutting blades may be moved along a cutting path a second time to complete the cutting of the sample into a precise square.

However, such corrugated sample cutters only include a parallel, fixed-width pair of cutting blades that cannot be adjusted. Thus, such sample cutters can only form corrugated samples with the parallel, fixed widths. Furthermore, tools are required to remove the blades of such corrugated sample cutters, which is time consuming and cumbersome.

BRIEF DESCRIPTION OF THE DRAWINGS

The accompanying drawings, which are incorporated in and constitute a part of this specification, illustrate one or more implementations and, together with the description, explain these implementations. In the drawings.

DETAILED DESCRIPTION

The following detailed description refers to the accompanying drawings. The same reference numbers in different drawings may identify the same or similar elements.

Overview

Systems and/or methods described herein may provide a corrugated sample cutter that may cut a variety of sample sizes for a variety of tests, such as edge crush tests, pin adhesion tests, etc. The corrugated sample cutter may include an adjustable width cutting assembly with two blades positioned inside the cutting assembly. One blade may be provided in a stationary portion of the cutting assembly and the other blade may be provided in a movable portion of the cutting assembly. A user of the corrugated sample cutter may quickly and easily adjust the width of the cutting assembly so that various widths may be obtained without any tools.

Figure 1:
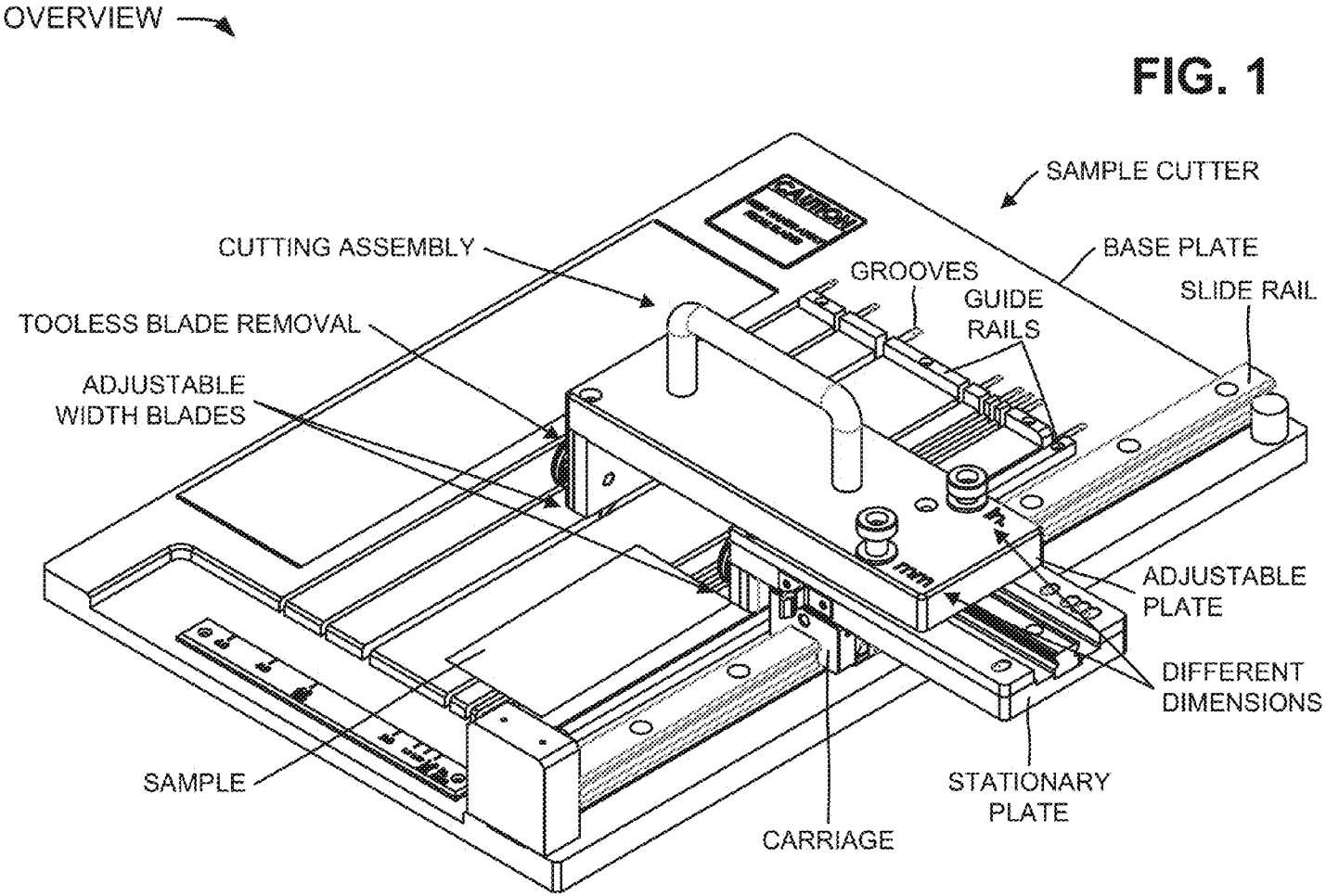
FIG. 1 is a diagram of an overview of an example implementation described herein.

FIG. 1 is a diagram of an overview of an example implementation described herein. As shown in the overview, a sample cutter may include a base plate that holds a sample (e.g., a corrugated sample) to be cut. Guide rails may connect to the base plate and may enable a user of sample cutter to position the sample. A slide rail may connect to the base plate and may receive and retain a carriage. The carriage may slidably move along the length of the slide rail. The carriage may support and connect to a cutting assembly that includes a stationary plate and an adjustable plate.

The stationary plate may not move in a direction perpendicular to the length of the slide rail. The stationary plate may connect to a blade or other cutting instrument that may be received in grooves of the base plate. The adjustable plate may move in a direction perpendicular to the length of the slide rail, and may slidably connect to the stationary plate. The adjustable plate may connect to another blade or other cutting instrument that may be received in grooves of the base plate. The adjustable plate may be adjustable in different dimensions (e.g., in inches, millimeters, etc.), and may enable the blades to provide adjustable cutting widths. The blades may be removed from the cutting assembly, without the need for mechanical tools, via thumbscrews.

In operation, the user of the sample cutter may set a sample size by adjusting the blade spacing of the cutting assembly. For example, the user may move the adjustable plate with respect to the stationary plate so that the blades are spaced apart for the desired sample size. The user may position the sample against the guide rails and the base plate of the sample cutter, and may move the cutting assembly through the sample to create a sample portion. For example, the user may move the cutting assembly along the length of the slide rail to cut the sample and create the sample portion.

The user may rotate the sample portion (e.g., ninety degrees), and may position the rotated sample portion against the guide rails and the base plate of the sample cutter. The user may again move the cutting assembly through the sample portion to create a final sample (e.g., with the desired sample size). For example, the user may move the cutting assembly along the length of the slide rail to cut the sample portion and create the final sample. The user may remove the final sample from the sample cutter, and may utilize the final sample in a variety of tests, such as, for example, an edge crush test.

Such an arrangement may provide a corrugated sample cutter with an adjustable width between cutting blades. The sample cutter may maintain and cut parallel sample edges at different widths, and the blades may provide clean and square cuts for the sample. The sample cutter may be portable, may not require pneumatic or electrical power, and may be used virtually anywhere. The arrangement may also enable the cutting blades to be replaced without the use of any tools.

Example Corrugated Sample Cutter

Figure 2:
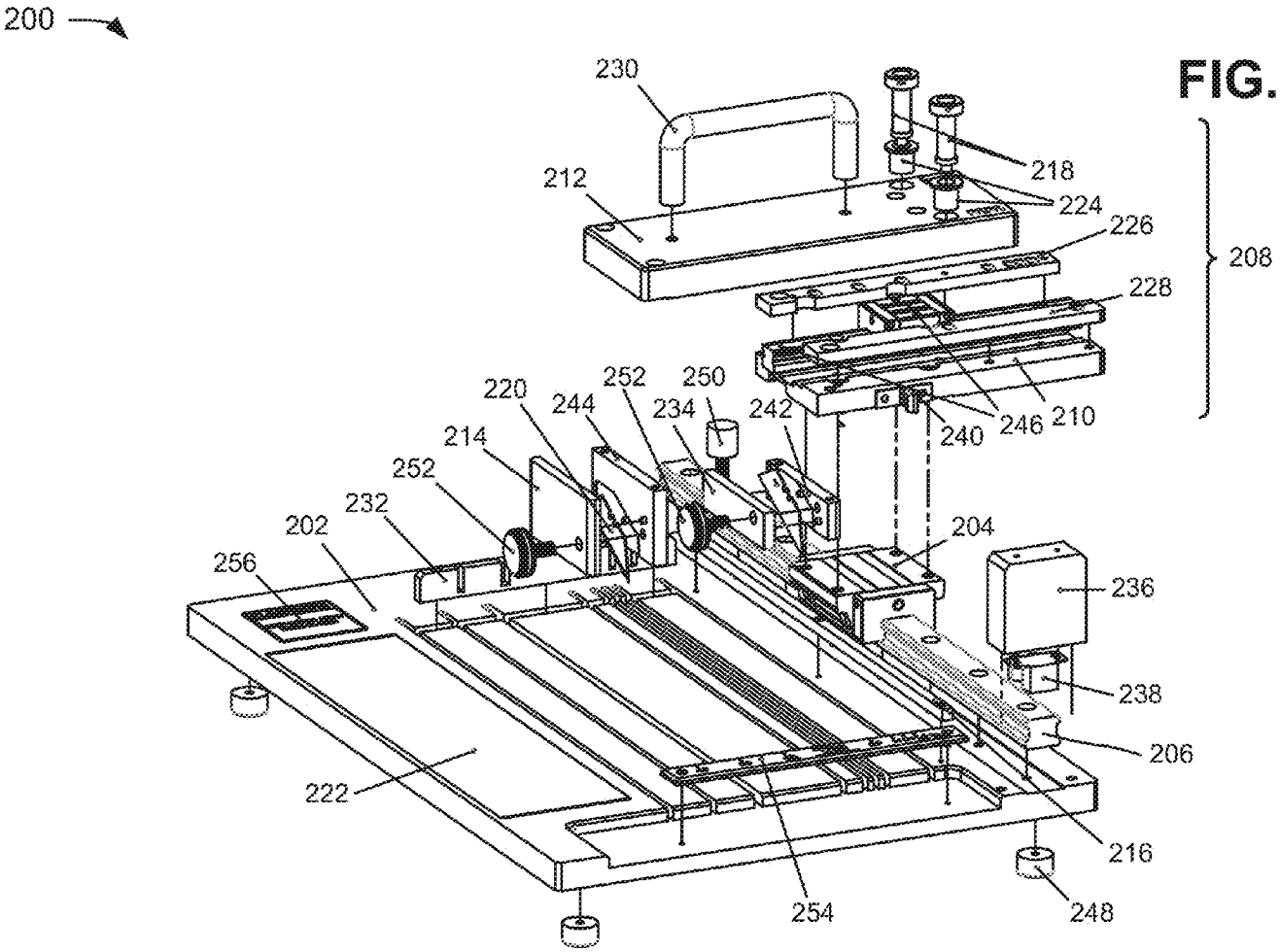
FIG. 2 is a diagram of an example isometric view of a corrugated sample cutter.

FIG. 2 is a diagram of an example isometric view of a corrugated sample cutter 200. As shown, sample cutter 200 may include a base plate 202, a carriage 204, a slide rail 206, a cutting assembly 208, a stationary plate 210, an adjustable plate 212, a first blade block cover 214, a side guide rail 216, location knobs 218, blades 220, anti-slip material 222, bushings 224, a first guide plate 226, a second guide plate 228, a handle 230, a top guide rail 232, a second blade block cover 234, a grab catch block 236, a grab catch roller 238, a grab catch clip 240, a second blade block 242, a first blade block 244, a linear slide assembly 246, a rubber foot 248, a bumper 250, thumb screws 252, a location scale 254, and a caution label 256.

Base plate 202 may include a plate to support the components of sample cutter 200. In some implementations, base plate 202 may have a variety of shapes and sizes depending upon the size and shape of a sample to be cut by sample cutter 200. For example, base plate 202 may be smaller in size if the sample is small (e.g., a one inch sample), and may be larger in size if the sample is large (e.g., a twelve inch sample). Base plate 202 may be made from a variety of materials, such as, for example, a metal or metal alloy (e.g., stainless steel, copper, iron, nickel, zinc, brass, bronze, aluminum, etc.), a plastic, a ceramic, a combination of the aforementioned materials, etc.

Carriage 204 may include a mechanism that connects to slide rail 206 in manner that carriage 204 may be moved linearly along a length of slide rail 206. For example, carriage 204 may communicate with a linear ball slide of slide rail 206 so that carriage 204 may move along the length of slide rail 206. Movement of carriage 204 may enable sample cutter 200 to cut a sample, as described herein. Carriage 204 may support and connect to stationary plate 210 and may prevent stationary plate 210 from moving in a direction perpendicular to slide rail 206. In some implementations, carriage 204 may have a variety of shapes and sizes depending upon the size and shape of the sample to be cut by sample cutter 200. For example, carriage 204 may be smaller in size if the sample is small, and may be larger in size if the sample is large.

Slide rail 206 may include a mechanism that enables carriage 204 to linearly move along a length of slide rail 206. For example, slide rail 206 may include a linear ball slide that communicates with carriage 204 so that carriage 204 may move along the length of slide rail 206. In some implementations, slide rail 206 may include different linear guides, such as a linear bushing on a precision rod, etc. Slide rail 206 may connect to a top surface of base plate 202, and may be provided near and extend along a side edge of base plate 202. In some implementations, slide rail 206 may have a variety of shapes and sizes depending upon the size and shape of base plate 202. Slide rail 206 may be made from a variety of materials, such as, for example, a metal or metal alloy, a plastic, a ceramic, a combination of the aforementioned materials, etc.

Cutting assembly 208 may include an assembly that cuts a sample. As shown in FIG. 2, cutting assembly 208 may include stationary plate 210, adjustable plate 212, location knobs 218, bushings 224, first guide plate 226, second guide plate 228, handle 230, grab catch clip 240, and linear slide assembly 246. The components of cutting assembly 208 may be moved along the length of slide rail 206 by carriage 204. In some implementations, cutting assembly 208 may have a variety of shapes and sizes depending upon the size and shape of base plate 202.

Stationary plate 210 may include a plate that is supported by and connected to carriage 204. Stationary plate 210 may not move in a direction perpendicular to the length of slide rail 206. Stationary plate 210 may be moved along the length of slide rail 206 via carriage 204. In some implementations, stationary plate 210 may have a variety of shapes and sizes depending upon the size and shape of the sample to be cut by sample cutter 200. For example, stationary plate 210 may be smaller in size if the sample is small, and may be larger in size if the sample is large. Stationary plate 210 may be made from a variety of materials, such as, for example, a metal or metal alloy, a plastic, a ceramic, a combination of the aforementioned materials, etc.

Adjustable plate 212 may include a plate that is supported by and connected to linear slide assembly 246 (e.g., which connects to stationary plate 210). Adjustable plate 212 may move in a direction perpendicular to the length of slide rail 206, and may slidably connect to stationary plate 210 (e.g., via linear slide assembly 246). Adjustable plate 212 may be adjustable in different dimensions (e.g., in inches, millimeters, etc.), and may enable sample cutter 200 to provide adjustable cutting widths. In some implementations, adjustable plate 212 may have a variety of shapes and sizes depending upon the size and shape of the sample to be cut by sample cutter 200. For example, adjustable plate 212 may be smaller in size if the sample is small, and may be larger in size if the sample is large. Adjustable plate 212 may be made from a variety of materials, such as, for example, a metal or metal alloy, a plastic, a ceramic, a combination of the aforementioned materials, etc.

First blade block cover 214 may include a cover to retain a first blade 220, or another cutting instrument, within first blade block 244. First blade block cover 214 and first blade block 244 may be sized and shaped to retain the first blade 220. Thumbscrew 252 may be used to retain first blade block cover 214 against first blade block 244. In some implementations, first blade block cover 214 may have a variety of shapes and sizes depending upon the size and shape of the sample to be cut by sample cutter 200.

Side guide rail 216 may include a guide rail that connects to the top surface of base plate 202. Side guide rail 216 may be provided near and extend along the side edge of base plate 202, adjacent to slide rail 206. Side guide rail 216 and top guide rail 232 (e.g., described below) may enable the sample to be positioned within sample cutter 200 for cutting. In some implementations, side guide rail 216 may have a variety of shapes and sizes depending upon the size and shape of the sample to be cut by sample cutter 200. For example, side guide rail 216 may be smaller in size if the sample is small, and may be larger in size if the sample is large. Side guide rail 216 may be made from a variety of materials, such as, for example, a metal or metal alloy, a plastic, a ceramic, a combination of the aforementioned materials, etc. In some implementations, side guide rail 216 may be arranged perpendicular to top guide rail 232, described below.

Location knobs 218 may include mechanisms (e.g., locking pins) to lock adjustable plate 212 at a location with respect to stationary plate 210. Location knobs 218 may be provided through bushings 224 and may be received in openings provided in first guide plate 226 and second guide plate 228. A first location knob 218 may be associated with first guide plate 226, and a second location knob 218 may be associated with second guide plate 228. When location knobs 218 are removed from the openings of first guide plate 226 and second guide plate 228, adjustable plate 212 may be adjusted in a direction perpendicular to slide rail 206. After adjusting adjustable plate 212, one of location knobs 218 may be received in a corresponding opening of first guide plate 226 or second guide plate 228, depending on the unit of measure (e.g., inches, millimeters, etc.) selected by the user.

Blades 220 may include mechanisms capable of cutting a corrugated sample. In some implementations, blades 220 may include blades that may be used in a utility knife, razor blades, or other cutting mechanisms. Blades 220 may be provided in first blade block 244 and second blade block 242, as described below. Blades 220 may be spaced apart at different widths in a parallel relation, and may be arranged to cut a sample at the same time. In some implementations, parallelism and perpendicularity of a final sample may be set and maintained by blades 220. Blades 220 may cut the sample in a direction parallel to the flutes of the corrugation.

Anti-slip material 222 may include a material provided on a portion of the surface of base plate 202. Anti-slip material 222 may prevent a sample from slipping when the sample is cut by sample cutter 200. In some implementations, anti-slip material 222 may include a polymer material, a rubber material, a plastic material, abrasive material, adhesive material, etc.

Bushings 224 may include independent plain bearings that may be inserted into openings of adjustable plate 212 to provide a bearing surface for location knobs 218. In some implementations, bushings 224 may protect the openings of adjustable plate 212 from location knobs 218 provided through the openings.

First guide plate 226 may include a mechanism that enables adjustable plate 212 to be moved in a direction perpendicular to slide rail 206 and in relation to stationary plate 210. First guide plate 226 may connect to an upper surface of stationary plate 210, and may include one or more openings spaced apart at predetermined distances (e.g., in a first unit of measure, such as inches). The first location knob 218 may be associated with first guide plate 226. When the first location knob 218 is removed from the openings of first guide plate 226, adjustable plate 212 may be adjusted in a direction perpendicular to slide rail 206. After adjusting adjustable plate 212, the first location knob 218 may be received in a corresponding opening of first guide plate 226. In some implementations, first guide plate 226 may have a variety of shapes and sizes depending upon the size and shape of the sample to be cut by sample cutter 200. For example, first guide plate 226 may be smaller in size if the sample is small, and may be larger in size if the sample is large.

Second guide plate 228 may include a mechanism that enables adjustable plate 212 to be moved in a direction perpendicular to slide rail 206 and in relation to stationary plate 210. Second guide plate 228 may connect to an upper surface of stationary plate 210, and may include one or more openings spaced apart at predetermined distances (e.g., in a second unit of measure, such as millimeters). The second location knob 218 may be associated with second guide plate 228. When the second location knob 218 is removed from the openings of second guide plate 228, adjustable plate 212 may be adjusted in a direction perpendicular to slide rail 206. After adjusting adjustable plate 212, the second location knob 218 may be received in a corresponding opening of second guide plate 228. In some implementations, second guide plate 228 may have a variety of shapes and sizes depending upon the size and shape of the sample to be cut by sample cutter 200. For example, second guide plate 228 may be smaller in size if the sample is small, and may be larger in size if the sample is large.

In some implementations, first guide plate 226 and/or second guide plate 228 may be integrally formed with stationary plate 210. Such an arrangement may enable easier assembly of sample cutter 200, may reduce the number of components of sample cutter 200, may reduce a number of fasteners required for sample cutter 200, may make sample cutter 200 more accurate, etc.

Handle 230 may include a mechanism that enables a user of sample cutter 200 to move cutting assembly 208 along the length of slide rail 206. In some implementations, the user may grab handle 230 with a hand and may move cutting assembly 208 along the length of slide rail 206 in order to cut a sample. Handle 230 may also enable the user to move adjustable plate 212 in relation to stationary plate 210. Handle 230 may be made from a variety of materials, such as, for example, a metal or metal alloy, a plastic, a ceramic, a combination of the aforementioned materials, etc.

Top guide rail 232 may include a guide rail that connects to the top surface of base plate 202. Top guide rail 232 may be provided near and extend along a top edge of base plate 202 (e.g., perpendicular to side guide rail 216). Side guide rail 216 and top guide rail 232 may enable the sample to be positioned within sample cutter 200 for cutting. In some implementations, top guide rail 232 may have a variety of shapes and sizes depending upon the size and shape of the sample to be cut by sample cutter 200. For example, top guide rail 232 may be smaller in size if the sample is small, and may be larger in size if the sample is large. Top guide rail 232 may be made from a variety of materials, such as, for example, a metal or metal alloy, a plastic, a combination of the aforementioned materials, etc.

Second blade block cover 234 may include a cover to retain a second blade 220, or another cutting instrument, within second blade block 242. Second blade block cover 234 and second blade block 242 may be sized and shaped to retain the second blade 220. Thumbscrew 252 may be used to retain second blade block cover 234 against second blade block 242. In some implementations, second blade block cover 234 may have a variety of shapes and sizes depending upon the size and shape of the sample to be cut by sample cutter 200.

Grab catch block 236 may include a block that retains grab catch roller 238 and prevents carriage 204 (e.g., and cutting assembly 208) from moving past an end of slide rail 206. Grab catch block 236 may connect to the top surface of base plate 202, adjacent to the end of slide rail 206. In some implementations, grab catch block 236 may have a variety of shapes and sizes depending upon the size and shape of the sample to be cut by sample cutter 200. For example, grab catch block 236 may be smaller in size if the sample is small, and may be larger in size if the sample is large. Grab catch block 236 may be made from a variety of materials, such as, for example, a metal or metal alloy, a plastic, a combination of the aforementioned materials, etc.

Grab catch roller 238 may include a friction catch for holding carriage 204 and preventing carriage 204 from moving. In some implementations, grab catch roller 238 may include two rollers arranged to receive grab catch clip 240 and prevent grab catch clip 240 from moving. Grab catch clip 240 may be received in grab catch roller 238 with the application of a force, and may be removed from grab catch roller 238 with the application of another force. Grab catch roller 238 may be connected to grab catch block 236 on a side of grab catch block 236 that faces carriage 204 and grab catch clip 240.

Grab catch clip 240 may include a clip that may be received and held in place by grab catch roller 238. In some implementations, grab catch clip 240 may be received and held in place by the two rollers of grab catch roller 238. Grab catch clip 240 may be connected to carriage 204 on a side of carriage 204 that faces grab catch block 236 and grab catch roller 238.

Second blade block 242 may include a block arranged to receive and retain the second blade 220. In some implementations, second blade block 242 may include a recessed portion sized and shaped to receive the size and shape of the second blade 220. Thumbscrew 252 may be used to retain second blade block cover 234 against second blade block 242. Second blade block 242 may connect to a lower surface of stationary plate 210. In some implementations, second blade block 242 may have a variety of shapes and sizes depending upon the size and shape of the sample to be cut by sample cutter 200.

First blade block 244 may include a block arranged to receive and retain the first blade 220. In some implementations, first blade block 244 may include a recessed portion sized and shaped to receive the size and shape of the first blade 220. Thumbscrew 252 may be used to retain first blade block cover 214 against first blade block 244. First blade block 244 may connect to a lower surface of adjustable plate 212. In some implementations, first blade block 244 may have a variety of shapes and sizes depending upon the size and shape of the sample to be cut by sample cutter 200.

Linear slide assembly 246 may include a carriage similar to carriage 204 and a slide rail similar to slide rail 206. The carriage and slide rail of linear slide assembly 246 may include the functionality and may operate in the manner described herein for carriage 204 and slide rail 206. The slide rail of linear slide assembly 246 may connect to an upper surface of stationary plate 210. The carriage of linear slide assembly 246 may connect to a lower surface of adjustable plate 212. The carriage may move along the length of the linear slide of linear slide assembly 246 to enable adjustable plate 212 to be moved in relation to stationary plate 210.

Rubber foot 248 may include a mechanism that supports base plate 202 and prevents base plate 202 from sliding on a surface on which sample cutter 200 is placed. In some implementations, rubber foot 248 may include a polymer material, a rubber material, a plastic material, etc. More than one rubber foot 248 may be connected to a bottom surface of base plate 202. For example, rubber foot 248 may be provided near each corner of the bottom surface of base plate 202.

Bumper 250 may include a mechanism that prevents carriage 204 (e.g., and cutting assembly 208) from moving past another end of slide rail 206 (e.g., the end of slide rail 206 that is opposite to the end adjacent to grab catch block 236). Bumper 250 may connect to the top surface of base plate 202, adjacent to the other end of slide rail 206. In some implementations, bumper 250 may have a variety of shapes and sizes depending upon the size and shape of the sample to be cut by sample cutter 200. For example, bumper 250 may be smaller in size if the sample is small, and may be larger in size if the sample is large. Bumper 250 may be made from a variety of materials, such as, for example, a metal or metal alloy, a plastic, a combination of the aforementioned materials, etc.

Thumb screws 252 may include mechanisms to retain first blade block cover 214 against first blade block 244, and second blade block cover 234 against second blade block 242. A first thumb screw 252 may be received in an opening of first blade block cover 214 and may force first blade block cover 214 against first blade block 244, to retain the first blade 202. A second thumb screw 252 may be received in an opening of second blade block cover 234 and may force second blade block cover 234 against second blade block 242, to retain the second blade 202.

Location scale 254 may be provided near an edge of base plate 202 and may be connected to a top surface of base plate 202. Location scale 254 may include scales of distances (e.g., in different units of measure) that may be used to set a distance between blades 220. The distance between blades 220 may be used to determine a size of the sample provided in sample cutter 200.

Caution label 256 may be attached to a top surface of base plate 202 and may provide warning information associated with operation of sample cutter 200. For example, the warning information may instruct a user of sample cutter to keep hands away from blades 220.

Although FIG. 2 shows example components of sample cutter 200, in some implementations, sample cutter 200 may include fewer components, different components, differently arranged components, or additional components than those depicted in FIG. 2. Alternatively, or additionally, one or more components of sample cutter 200 may perform one or more tasks described as being performed by one or more other sample cutter of sample cutter 200. In some implementations, one or more components of sample cutter 200 may connect to one or more other components of sample cutter 200 via screw(s), nuts and bolts, bolt(s), a adhesive material, a welding material, rivet(s), pin(s), etc.

Figure 3A:
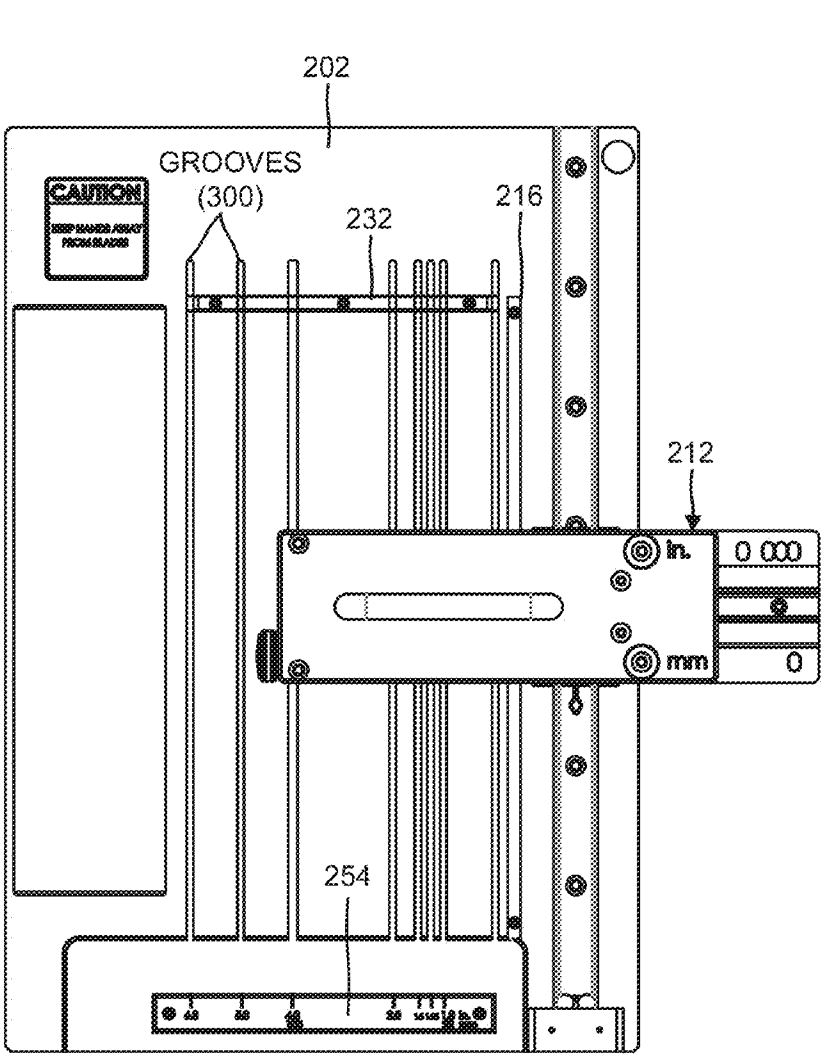
FIG. 3A is a diagram of an example top view of the corrugated sample cutter.

FIG. 3A is a diagram of an example top view of corrugated sample cutter 200. As shown in FIG. 3A, grooves 300 may be provided in multiple locations of base plate 202. In some implementations, grooves 300 may be provided at locations that enable the first blade 220 to be spaced apart from the second blade 220 by a variety of distances (e.g., in different units of measure). A particular groove 300 closest to side guide rail 216 may be associated with and receive the second blade 220 provided in second blade block 242. The remaining grooves 300 may be associated with and receive the first blade 220 provided in first blade block 244. Adjustable plate 212 may be adjusted so that the first blade 220 aligns with one of the remaining grooves 300. Top guide rail 232 may include grooves that communicate with grooves 300 provided in base plate 202. The user of sample cutter 200 may utilize location scale 254 to determine a distance between the first blade 220 and the second blade 220.

Figure 3B:
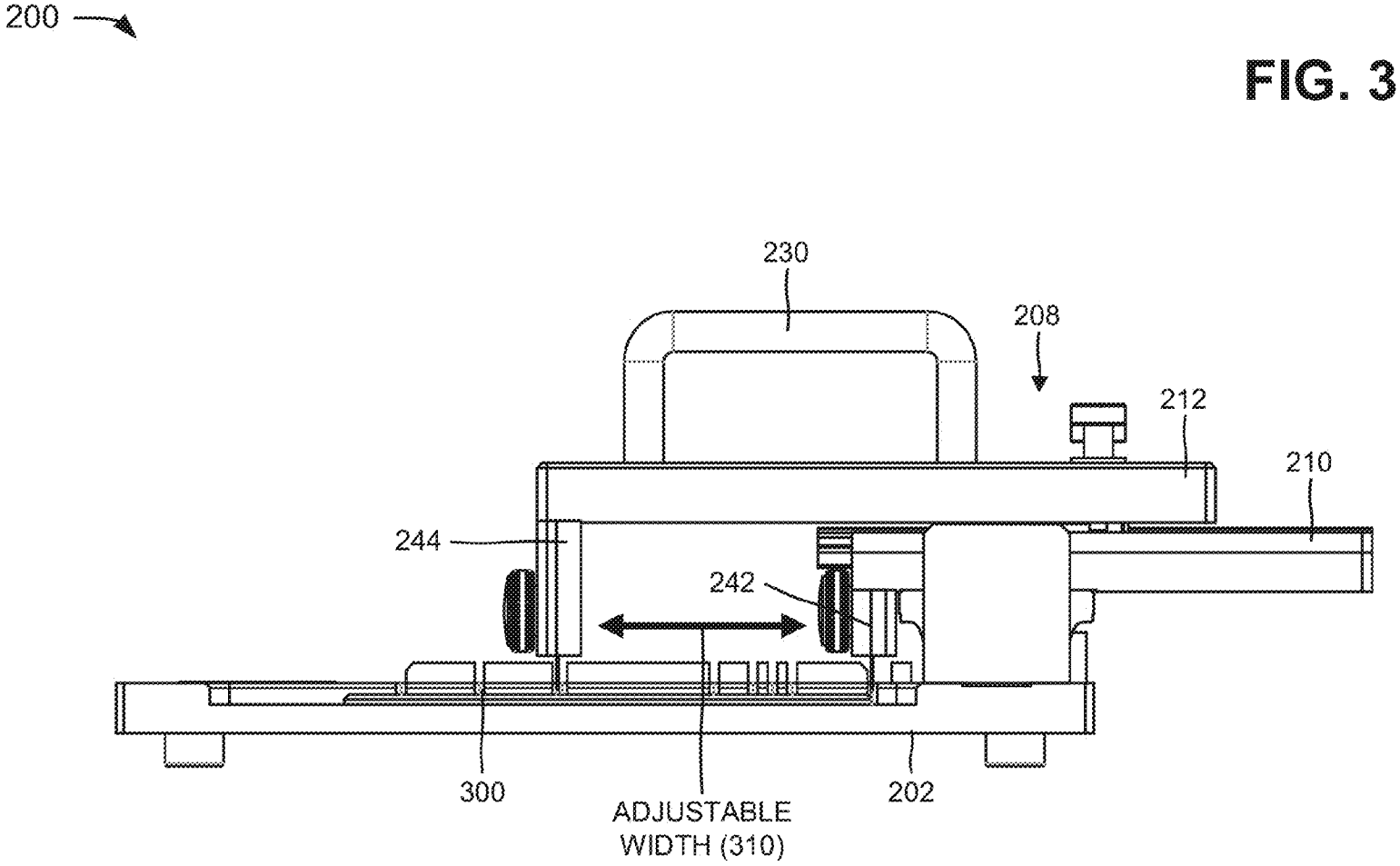
FIG. 3B is a diagram of an example front view of the corrugated sample cutter.

FIG. 3B is a diagram of an example front view of corrugated sample cutter 200. As shown in FIG. 3B, the user of sample cutter 200 may utilize handle 230 to move adjustable plate 212 in relation to stationary plate 210 of cutting assembly 208. Movement of adjustable plate 212 in relation to stationary plate 210 may provide an adjustable width 310 for cutting a sample with the first blade 220 (e.g., provided in first blade block 244) and the second blade 220 (e.g., provided in second blade block 242). In some implementations, the first blade 220 and the second blade 220 may maintain a parallel relationship at different adjustable widths 310.

Figure 3C:
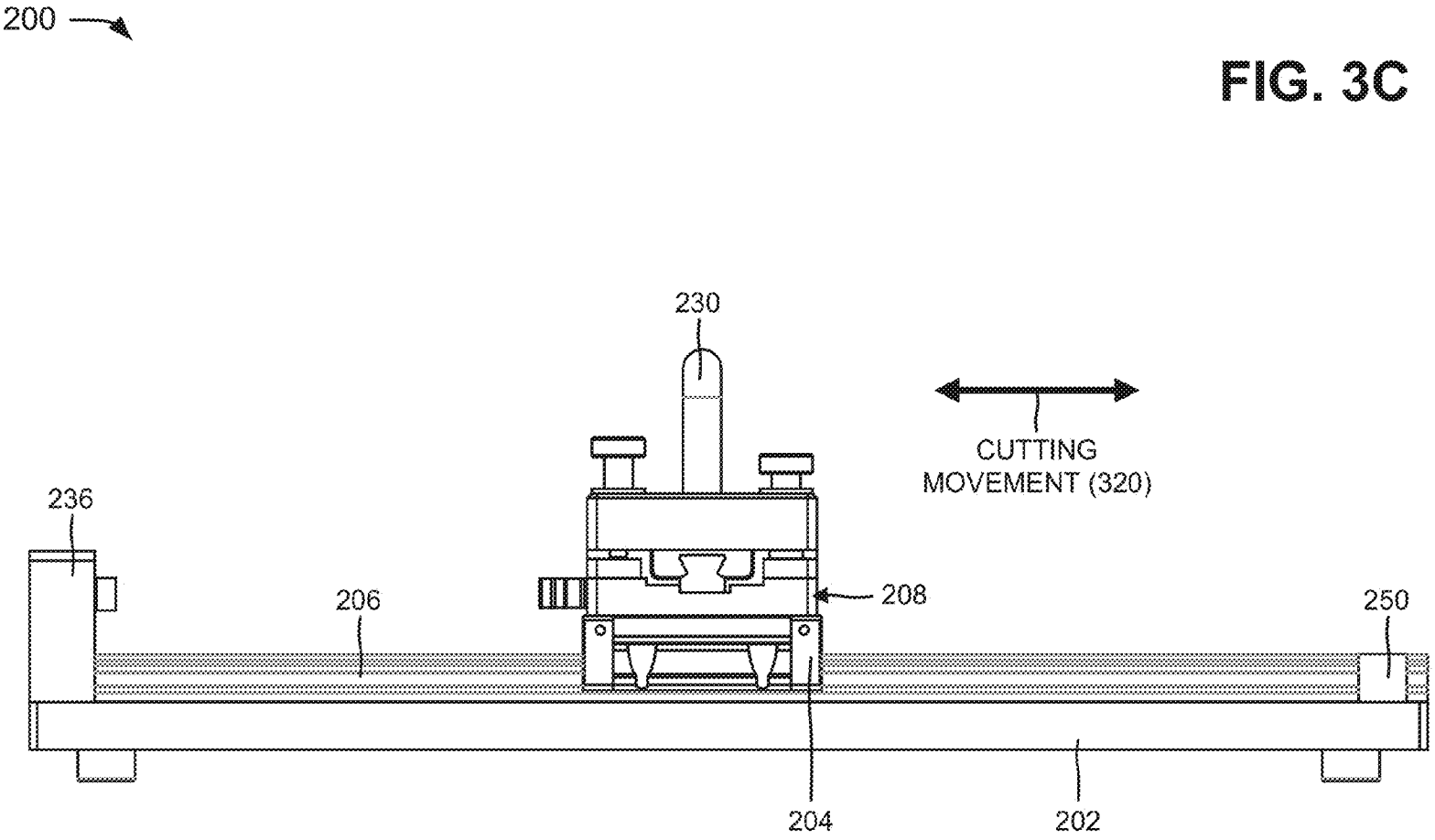
FIG. 3C is a diagram of an example side view of the corrugated sample cutter.

FIG. 3C is a diagram of an example side view of corrugated sample cutter 200. As shown in FIG. 3C, the user of sample cutter 200 may utilize handle 230 to move carriage 204 and cutting assembly 208 along the length of slide rail 206. In some implementations, carriage 204 and cutting assembly 208 may be moved along the length of slide rail 206, between grab catch block 236 and bumper 250. The user may move cutting assembly 208 along slide rail 206 when cutting a sample and such movement may be referred to as a cutting movement 320.

Although FIGS. 3A-3C show example components of sample cutter 200, in some implementations, sample cutter 200 may include fewer components, different components, differently arranged components, or additional components than depicted in FIGS. 3A-3C. Alternatively, or additionally, one or more components of sample cutter 200 may perform one or more tasks described as being performed by one or more other components of sample cutter 200.

Example Process for Cutting a Sample with the Sample Cutter

Figure 4:
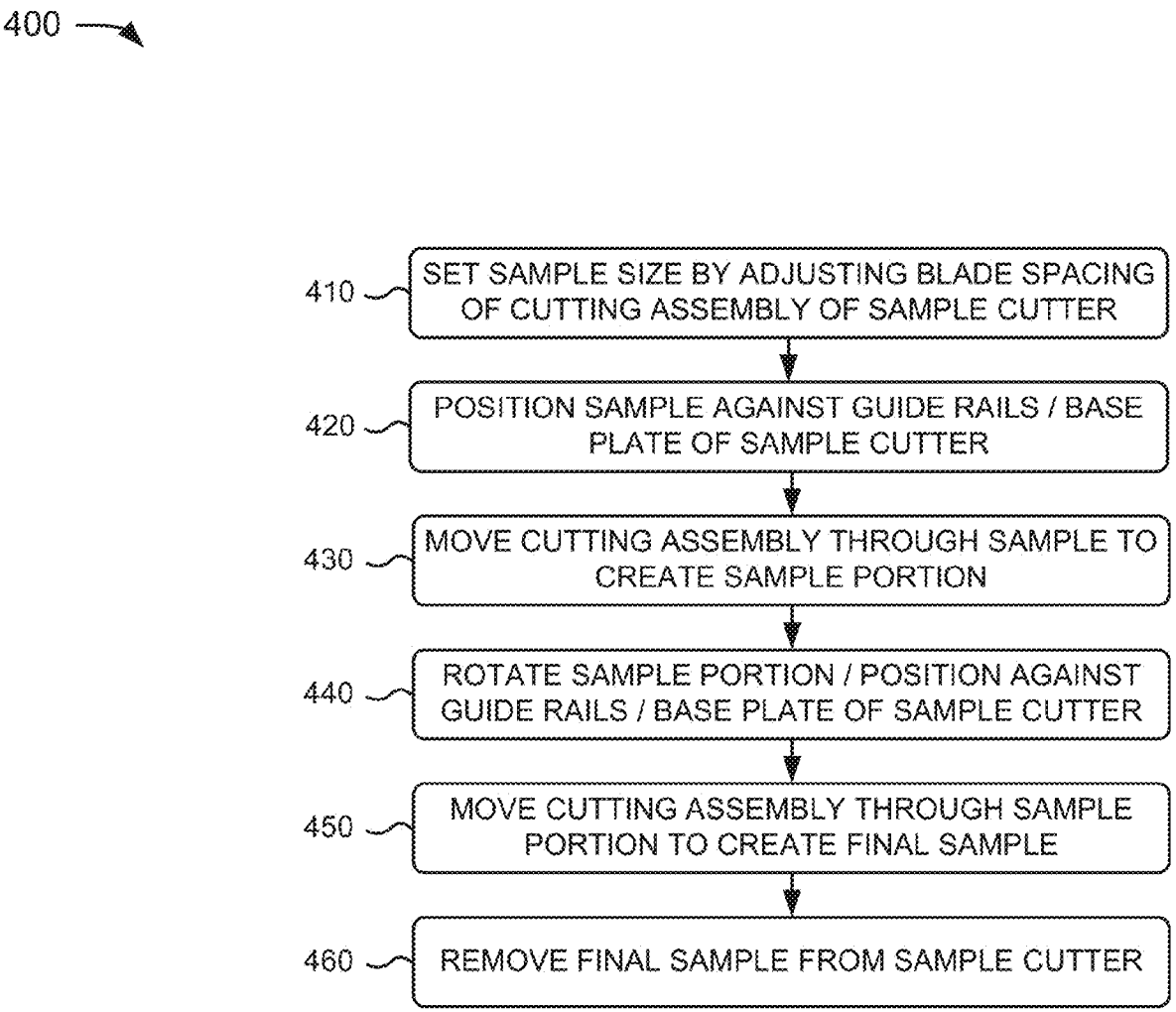
FIG. 4 is a flow chart of an example process for cutting a sample with the corrugated sample cutter.

FIG. 4 is a flow chart of an example process 400 for cutting a sample with a corrugated sample cutter. In some implementations, process 400 may be performed with sample cutter 200.

As shown in FIG. 4, process 400 may include setting a sample size by adjusting blade spacing of a cutting assembly of a sample cutter (block 410). For example, a user of sample cutter 200 may utilize location knobs 218 to adjust the spacing between blades 220. In some implementations, the user may remove the first location knob 218 from an opening of first guide plate 226, and may move adjustable plate 212 in a direction perpendicular to slide rail 206 to adjust the spacing between blades 220. After moving adjustable plate 212, the first location knob 218 may be received in a corresponding opening of first guide plate 226. In some implementations, the user may remove the second location knob 218 from an opening of second guide plate 228, and may move adjustable plate 212 in a direction perpendicular to slide rail 206 to adjust the spacing between blades 220. After moving adjustable plate 212, the second location knob 218 may be received in a corresponding opening of second guide plate 228. In some implementations, the user may utilize location scale 254 to adjust the spacing between blades 220. In some implementations, the spacing between blades 220 may be adjusted when grab catch roller 238 is connected to grab catch clip 240 and carriage 204 is in a locked position.

As further shown in FIG. 4, process 400 may include positioning the sample against guide rails and a base plate of the sample cutter (block 420). For example, the user may place a corrugated sample on the top surface of base plate 202, and may position one edge of the sample against top guide rail 232. The user may position another edge of the sample against side guide rail 216. In some implementations, positioning the edges of the sample against top guide rail 232 and side guide rail 216 may prevent the sample from moving when the sample is cut by sample cutter 200.

Returning to FIG. 4, process 400 may include moving the cutting assembly through the sample to create a sample portion (block 430). For example, the user may grasp handle 230 of cutting assembly 208, and may move cutting assembly 208 toward and through the sample. Blades 220 may engage and cut the sample as cutting assembly 208 is moved through the sample. In some implementations, the user may move blades 220 past top guide rail 232 in order to cut the sample.

As further shown in FIG. 4, process 400 may include rotating the sample portion and positioning the sample portion against the guide rails and the base plate of the sample cutter (block 440). For example, the user may remove a cut portion of the sample, and may rotate (e.g., ninety degrees) the remaining portion of the sample in sample cutter 200. The user may place the rotated sample portion on the top surface of base plate 202, and may position one edge of the sample portion against top guide rail 232. The user may position another edge of the sample portion against side guide rail 216. In some implementations, positioning the edges of the sample portion against top guide rail 232 and side guide rail 216 may prevent the sample portion from moving when the sample is cut by sample cutter 200.

Returning to FIG. 4, process 400 may include moving the cutting assembly through the sample portion to create a final sample (block 450). For example, the user may grasp handle 230 of cutting assembly 208, and may move cutting assembly 208 toward and through the sample portion. Blades 220 may engage and cut the sample portion as cutting assembly 208 is moved through the sample portion. In some implementations, the user may move cutting assembly 208 past top guide rail 232 in order to cut the sample portion and produce a final sample.

As further shown in FIG. 4, process 400 may include removing the final sample from the sample cutter (block 460). For example, the user may remove a cut portion of the sample portion from sample cutter 200, and may remove the final, completed sample from sample cutter 200. The final sample may be utilized in a variety of tests, such as edge crush tests, pin adhesion tests, etc.

While FIG. 4 shows process 400 as including a particular quantity and arrangement of blocks, in some implementations, process 400 may include fewer blocks, additional blocks, or a different arrangement of blocks. Additionally, or alternatively, some of the blocks may be performed in parallel.

Example Operation of the Sample Cutter

FIGS. 5A-5D are diagrams of an example 500 of the process described above with respect to FIG. 4. In example 500, assume that a user of sample cutter 200 removes the first location knob 218 from an opening of first guide plate 226, and utilizes handle 230 to move adjustable plate 212 in relation to stationary plate 210, as indicate by reference number 510 in FIG. 5A. The user may move adjustable plate 212 in relation to stationary plate 210 until a desired sample size 520 is set by the user. Sample size 520 may correspond to a spacing provided between blades 220, as further shown in FIG. 5A. After sample size 520 is set, the first location knob 218 may be received in a corresponding opening of first guide plate 226.

In some implementations, the user may remove the second location knob 218 from an opening of second guide plate 228, and may move adjustable plate 212 in relation to stationary plate 210 until sample size 520 is set by the user. After sample size 520 is set, the second location knob 218 may be received in a corresponding opening of second guide plate 228.

Figure 5A:
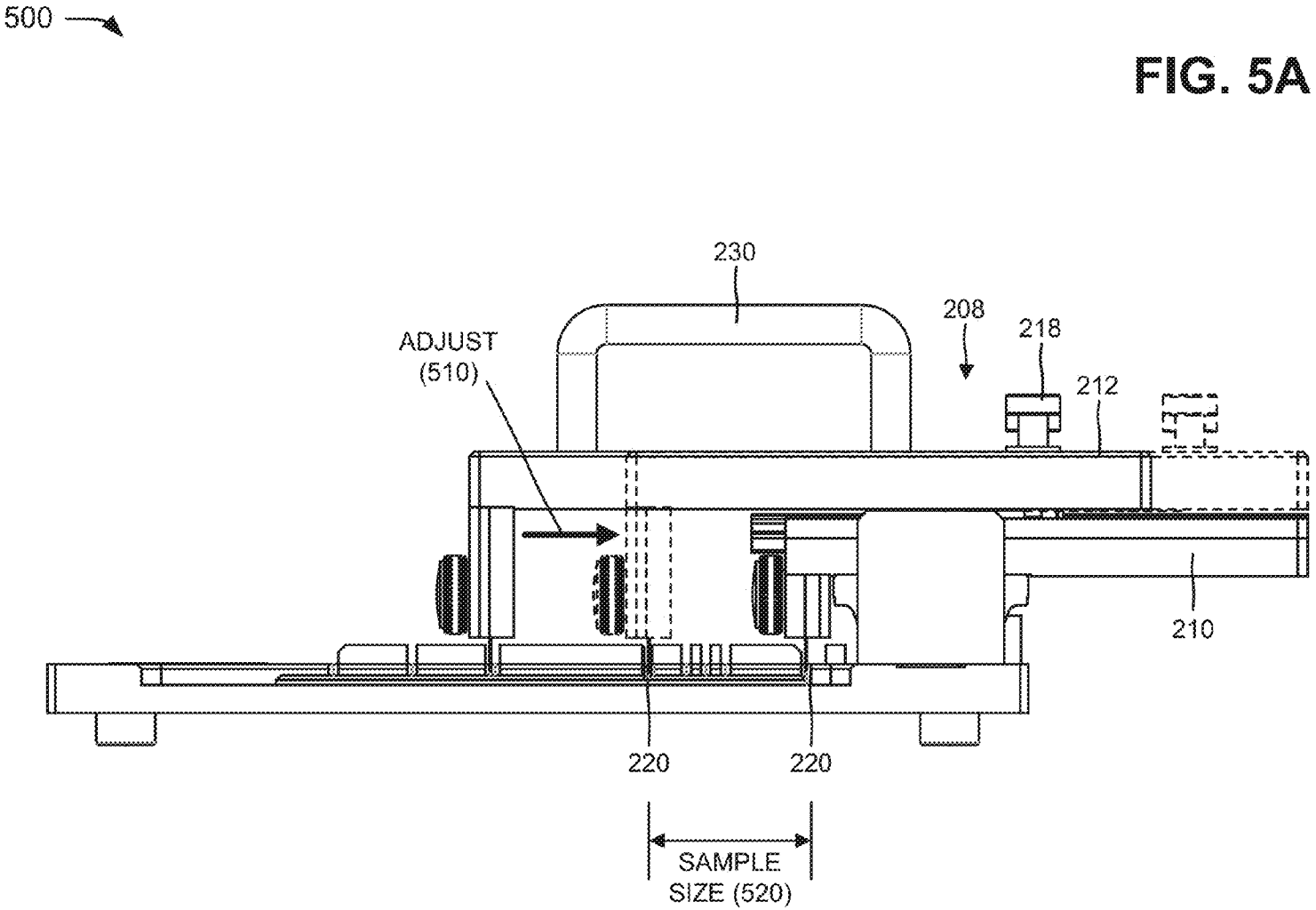
FIGS. 5A-5D are diagrams of an example of the process described above with respect to FIG. 4.
Figure 5B:
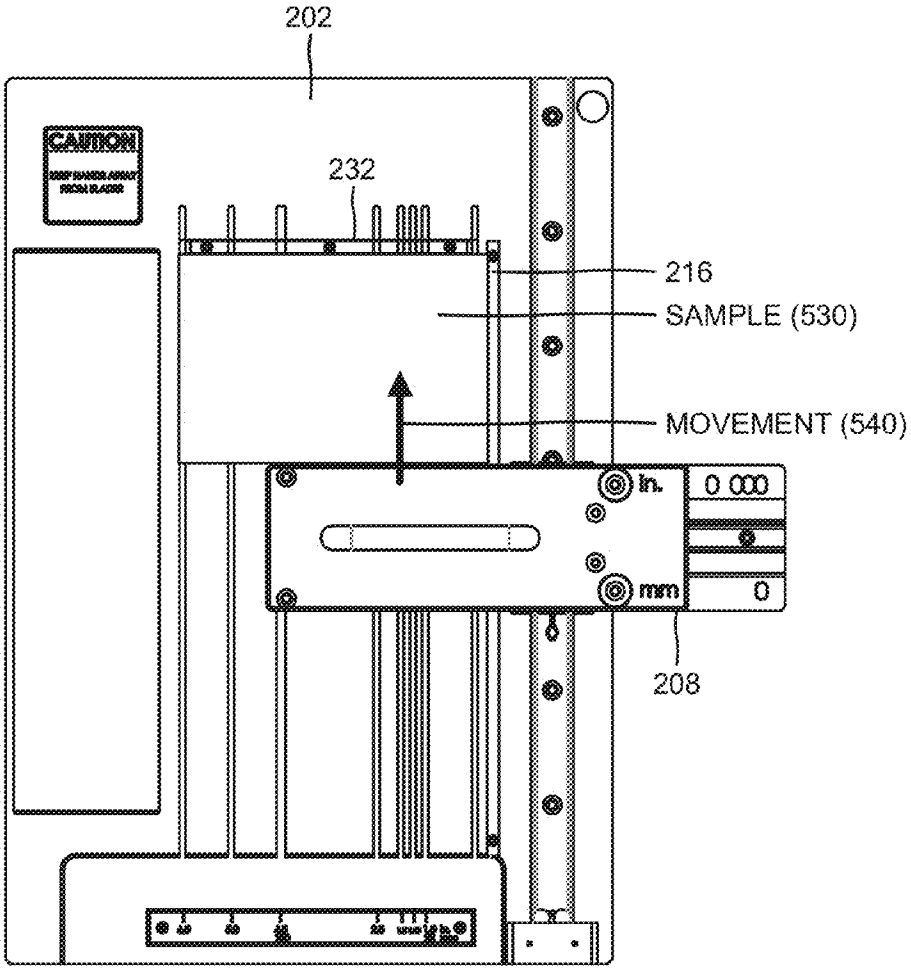

As shown in FIG. 5B, the user may place a corrugated sample 530 on the top surface of base plate 202, and may position one edge of sample 530 against top guide rail 232. The user may position another edge of sample 530 against side guide rail 216. This may assure that edges of sample 530 are positioned in a correct manner, and may prevent sample 530 from moving when sample 530 is cut by sample cutter 200. As further shown in FIG. 5B, assume that the user moves cutting assembly 208 toward and through sample 530, as indicated by reference number 540. Blades 220 may engage and cut sample 530 as cutting assembly 208 is moved through sample 530. In example 500, the user may move blades 220 past top guide rail 232 in order to cut sample 530.

Figure 5C:
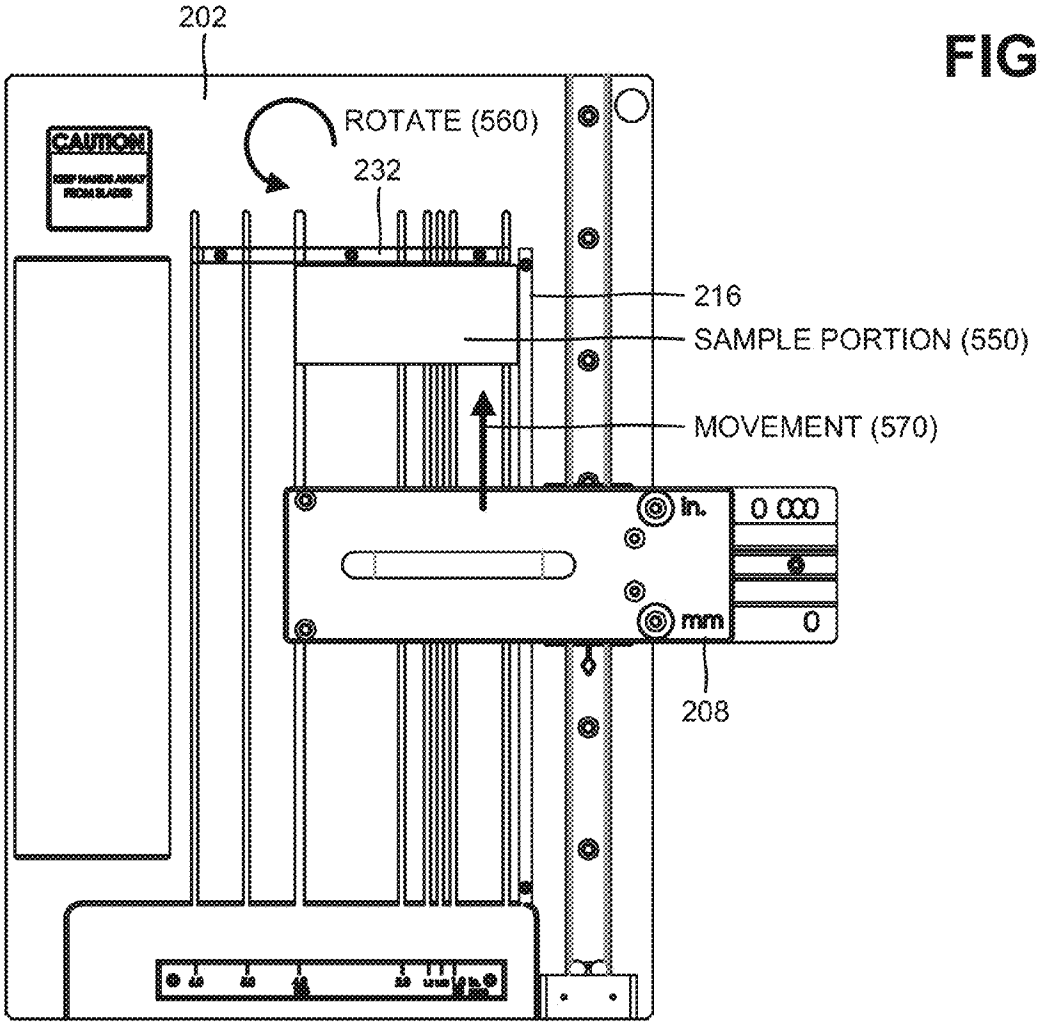

In example 500, assume that the user removes a cut portion of sample 530 and is left with a remaining portion 550 of sample 530, as shown in FIG. 5C. The user may rotate 560 (e.g., ninety degrees) sample portion 550, and may place the rotated sample portion 550 on the top surface of base plate 202. The user may position one edge of sample portion 550 against top guide rail 232, and may position another edge of sample portion 550 against side guide rail 216. This may assure that edges of sample portion 550 are positioned in a correct manner, and may prevent sample portion 550 from moving when sample portion 550 is cut by sample cutter 200. As further shown in FIG. 5C, assume that the user moves cutting assembly 208 toward and through sample portion 550, as indicated by reference number 570. Blades 220 may engage and cut sample portion 550 as cutting assembly 208 is moved through sample portion 550. In example 500, the user may move blades 220 past top guide rail 232 in order to cut sample portion 550.

Figure 5D:
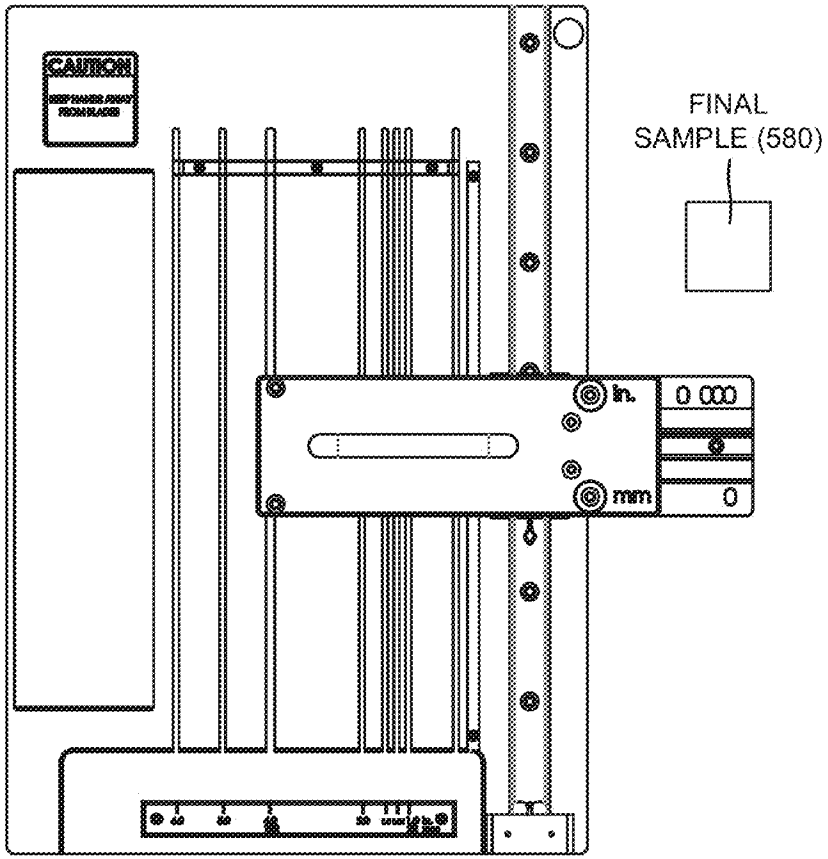

In example 500, further assume that the user removes a cut portion of sample portion 550 from sample cutter 200, and removes a final, completed sample 580 from sample cutter 200, as shown in FIG. 5D. Final sample 580 may be utilized in a variety of tests, such as edge crush tests, pin adhesion tests, etc.

As indicated above, FIGS. 5A-5D are provided merely as an example. Other examples are possible and may differ from what was described with regard to FIGS. 5A-5D.

Example Process for Replacing Blades in the Sample Cutter

Figure 6:
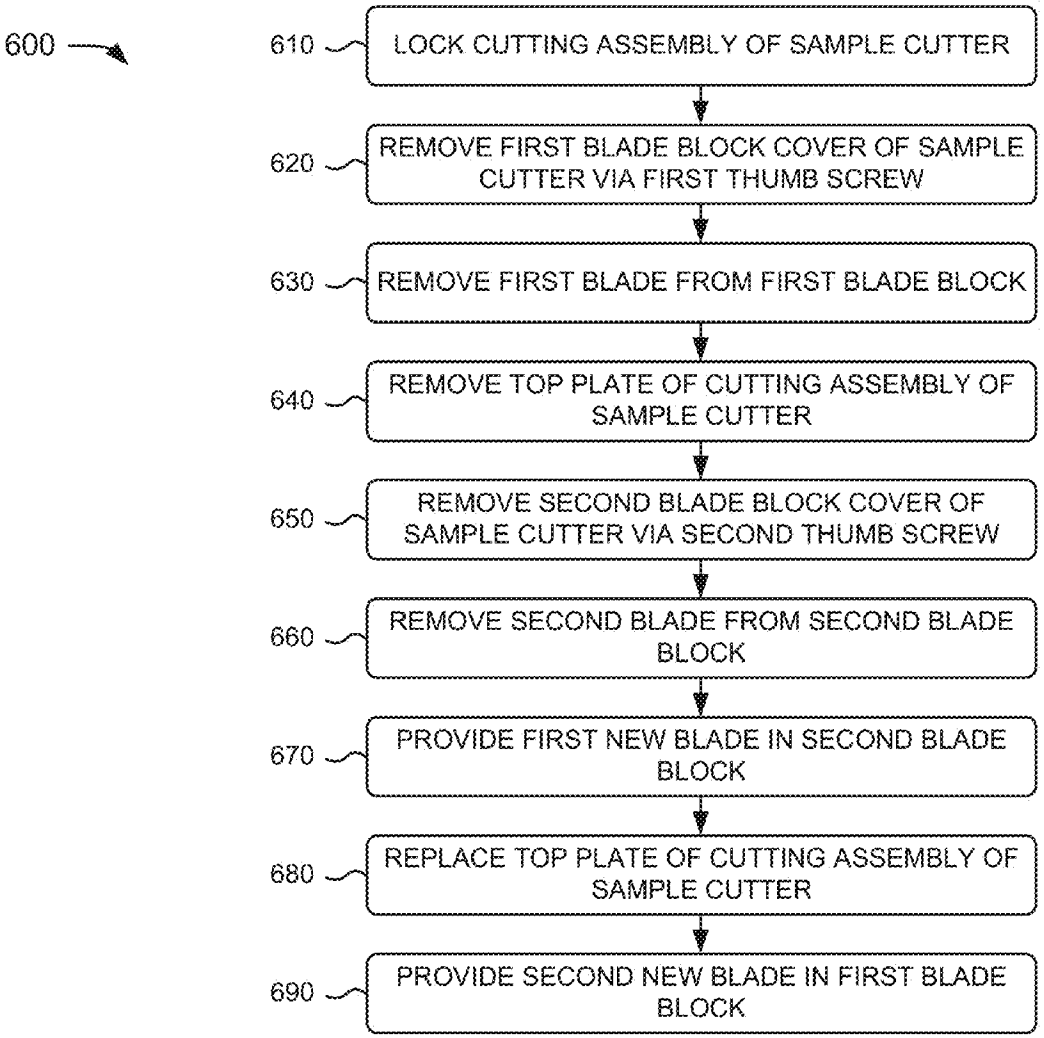
FIG. 6 is a flow chart of an example process for replacing blades in the corrugated sample cutter.

FIG. 6 is a flow chart of an example process 600 for replacing blades in a corrugated sample cutter. In some implementations, process 600 may be performed with sample cutter 200.

As shown in FIG. 6, process 600 may include locking a cutting assembly of a sample cutter (block 610). For example, a user of sample cutter 200 may move cutting assembly 208 toward grab catch block 236 until grab catch roller 238 engages and retains grab catch clip 240 (e.g., connected to carriage 204). In some implementations, a force (e.g., greater than a particular amount) may be required to insert grab catch clip 240 in grab catch roller 238 and to remove grab catch clip 240 from grab catch roller 238. When grab catch clip 240 is retained in grab catch roller 238, cutting assembly 208 may be in a locked position.

As further shown in FIG. 6, process 600 may include removing a first blade block cover of the sample cutter via a first thumb screw (block 620). For example, the user may unscrew the first thumb screw 252 associated with first blade block cover 214, and may put the first thumb screw 252 aside. With the first thumb screw 252 removed, the user may remove first blade block cover 214 from first blade block 244, and may put first blade block cover 214 aside.

Returning to FIG. 6, process 600 may include removing a first blade from a first blade block of the sample cutter (block 630). For example, the first blade 220 may be retained in first blade block 244 via one or more magnets. The user may carefully remove the first blade 220 from first blade block 244 by exerting a force (e.g., that overcomes the force of the one or more magnets) on the first blade 220. The user may discard the first blade 220.

As further shown in FIG. 6, process 600 may include removing a top plate of the cutting assembly of the sample cutter (block 640). For example, the user may lift location knobs 218 so that they are removed from the openings of first guide plate 226 and second guide plate 228. The user may remove adjustable plate 212 from linear slide assembly 246 and may put adjustable plate 212 (e.g., and first blade block 244) aside.

Returning to FIG. 6, process 600 may include removing a second blade block cover of the sample cutter via a second thumb screw (block 650). For example, the user may unscrew the second thumb screw 252 associated with second blade block cover 234, and may put the second thumb screw 252 aside. With the second thumb screw 252 removed, the user may remove second blade block cover 234 from second blade block 242, and may put second blade block cover 234 aside.

As further shown in FIG. 6, process 600 may include removing a second blade from a second blade block of the sample cutter (block 660). For example, the first blade 220 may be retained in second blade block 242 via one or more magnets. The user may carefully remove the second blade 220 from second blade block 242 by exerting a force (e.g., that overcomes the force of the one or more magnets) on the second blade 220. The user may discard the second blade 220.

Returning to FIG. 6, process 600 may include providing a first new blade in the second blade block (block 670). For example, the user may place a new blade 220 in second blade block 242, and the one or more magnets may retain the new blade 220 in second blade block 242. The user may replace second blade block cover 234 on second blade block 242, and may tighten the second thumb screw 252 so that second blade block cover 234 and second blade block 242 are connected.

As further shown in FIG. 6, process 600 may include replacing the top plate of the cutting assembly of the sample cutter (block 680). For example, while lifting location knobs 218, the user may slide adjustable plate 212 back on to linear slide assembly 246. The user may release location knobs 218 so that location knobs 218 may be provided in the openings of first guide plate 226 and second guide plate 228.

Returning to FIG. 6, process 600 may include providing a second new blade in the first blade block (block 690). For example, the user may place another new blade 220 in first blade block 244, and the one or more magnets may retain the new blade 220 in first blade block 244. The user may replace first blade block cover 214 on first blade block 244, and may tighten the first thumb screw 252 so that first blade block cover 214 and first blade block 244 are connected.

While FIG. 6 shows process 600 as including a particular quantity and arrangement of blocks, in some implementations, process 600 may include fewer blocks, additional blocks, or a different arrangement of blocks. Additionally, or alternatively, some of the blocks may be performed in parallel.

Example Blade Replacement Operations

Figure 7A:
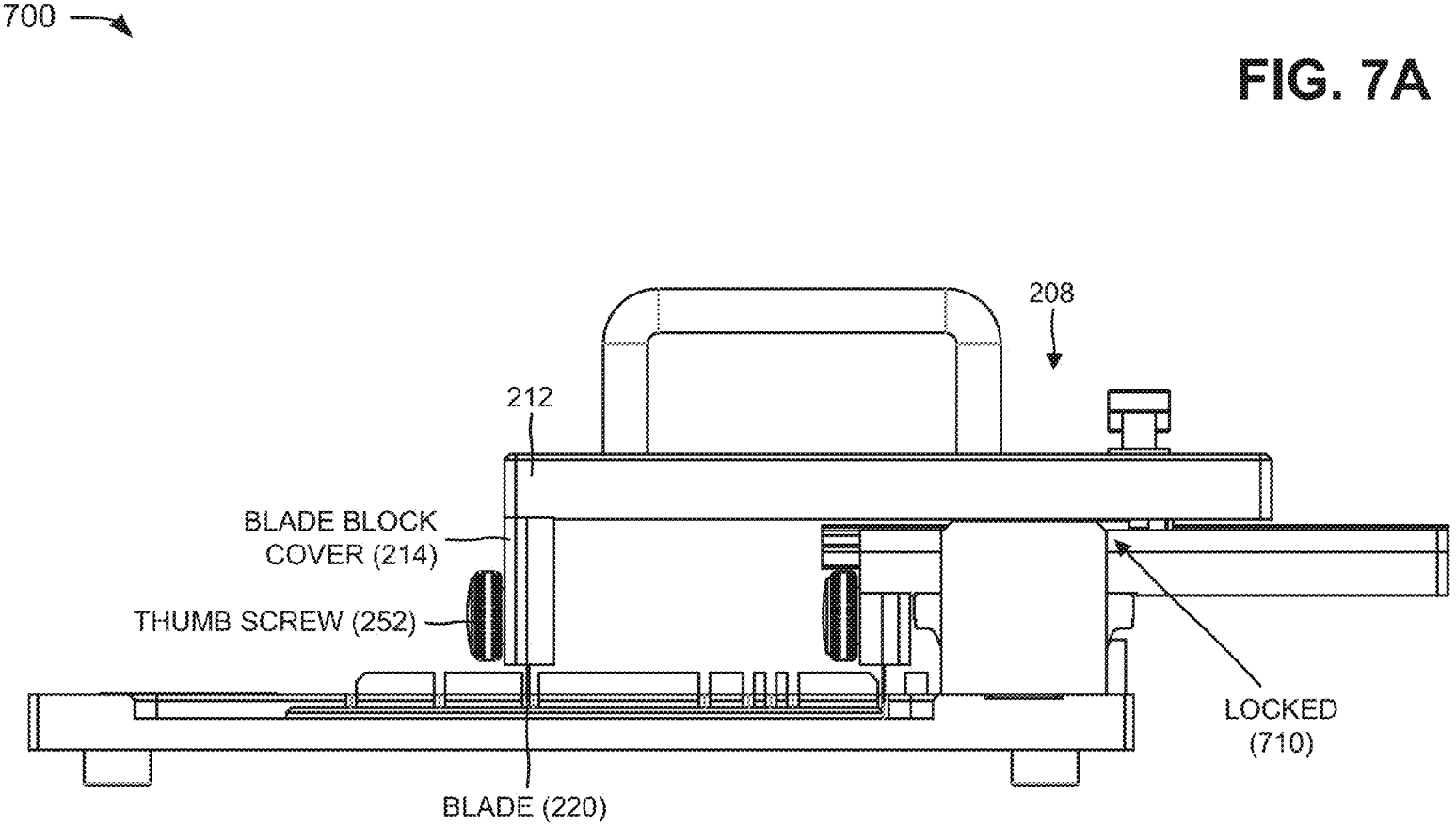
FIGS. 7A-7F are diagrams of an example of the process described above with respect to FIG. 6.

FIGS. 7A-7F are diagrams of an example 700 of the process described above with respect to FIG. 6. In example 700, assume that a user of sample cutter 200 wants to replace blades 220. Further assume that the user moves cutting assembly 208 to a locked position 710, as shown in FIG. 7A. For example, the user may move cutting assembly 208 toward grab catch block 236 until grab catch roller 238 engages and retains grab catch clip 240 (e.g., connected to carriage 204). When grab catch clip 240 is retained in grab catch roller 238, cutting assembly 208 may be in locked position 710. With reference to FIG. 7A, the user may unscrew the first thumb screw 252 associated with first blade block cover 214, and may remove first blade block cover 214 from first blade block 244.

Figure 7B:
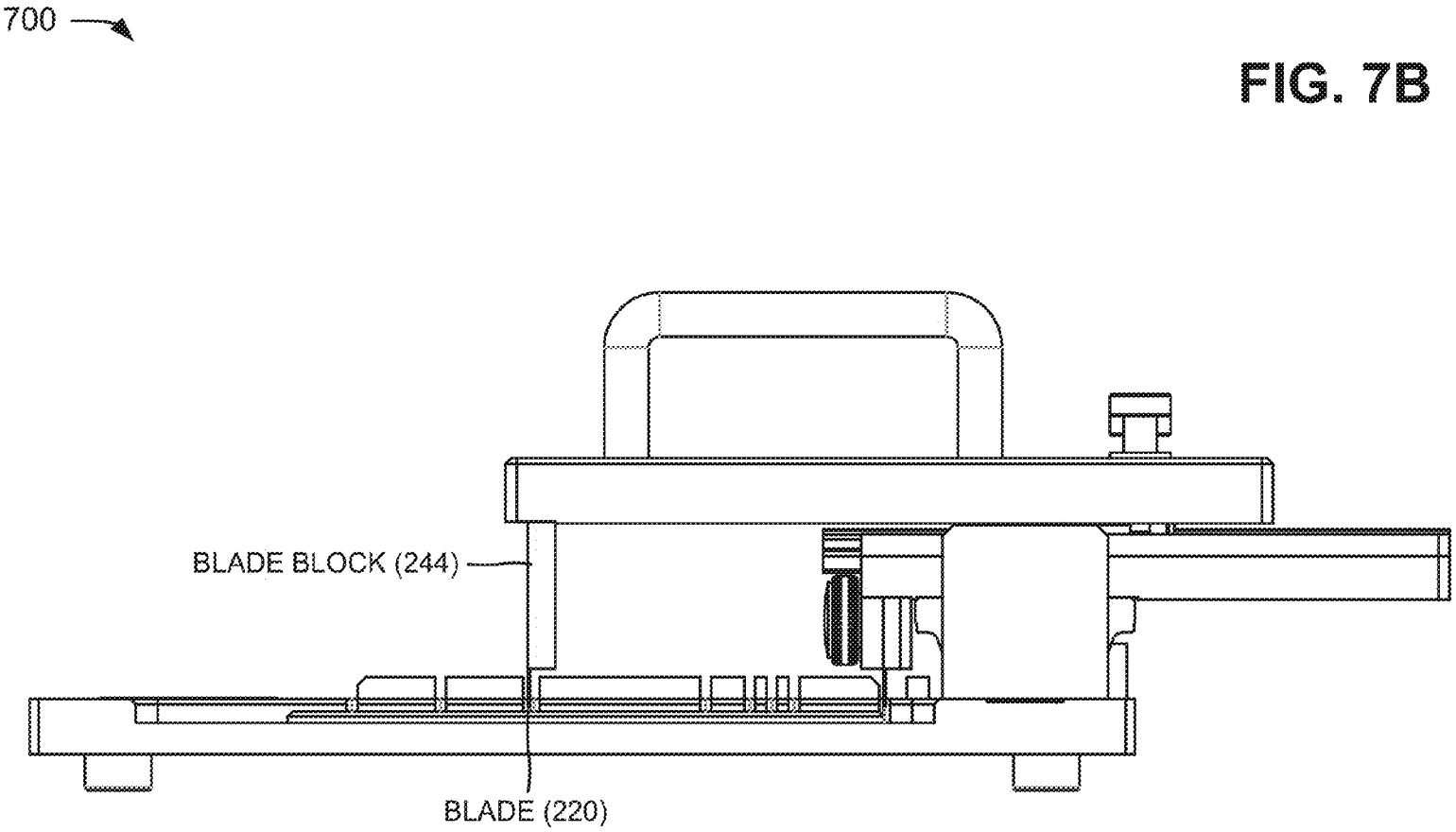
Figure 7C:
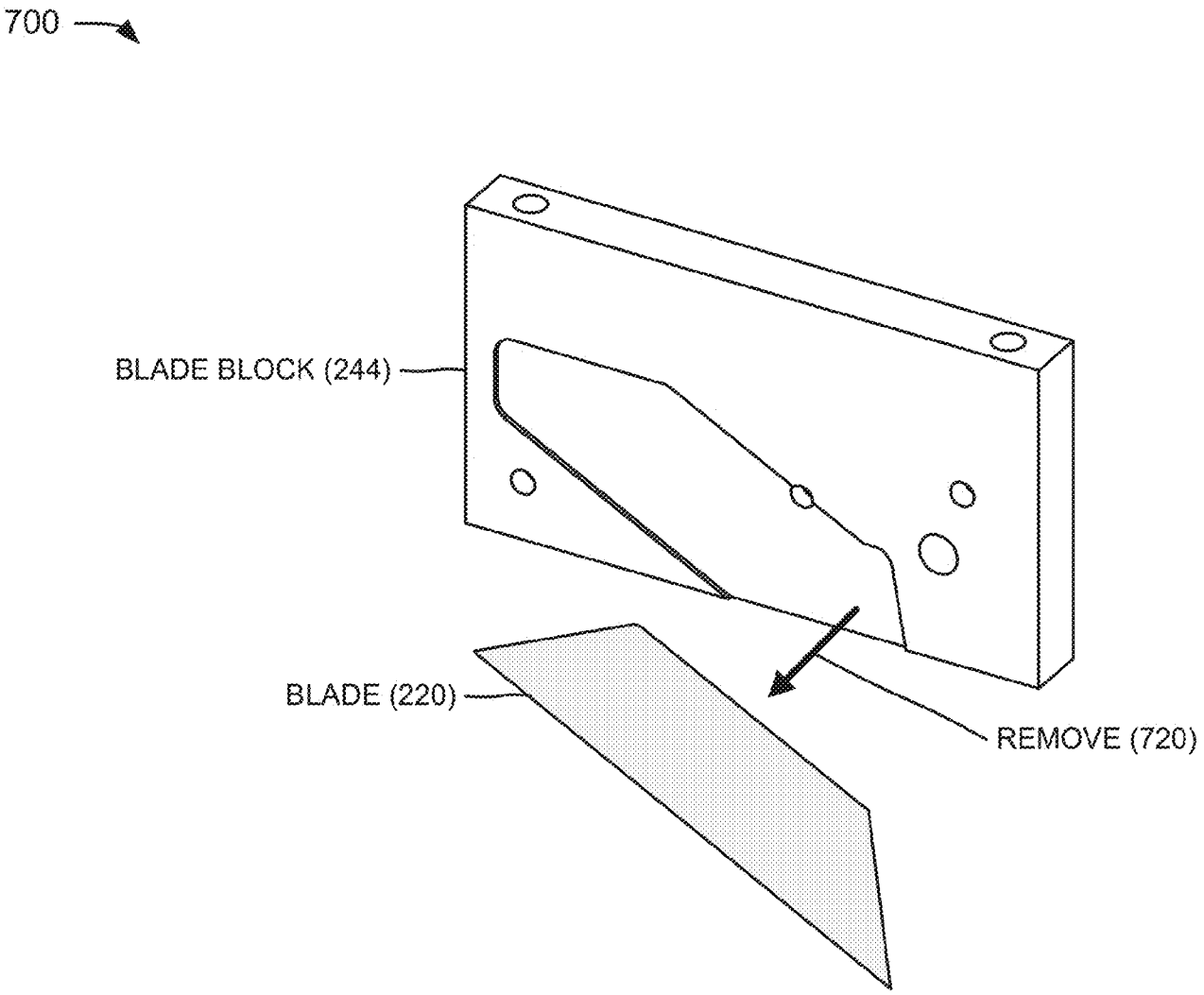

After removing first blade block cover 214, the first blade 220 may be accessible in first blade block 244, as shown in FIG. 7B. The first blade 220 may be retained in first blade block 244 via one or more magnets. The user may carefully remove the first blade 220 from first blade block 244 by exerting a force (e.g., that overcomes the force of the one or more magnets) on the first blade 220, as indicated by reference number 720 in FIG. 7C. The user may discard the first blade 220.

Figure 7D:
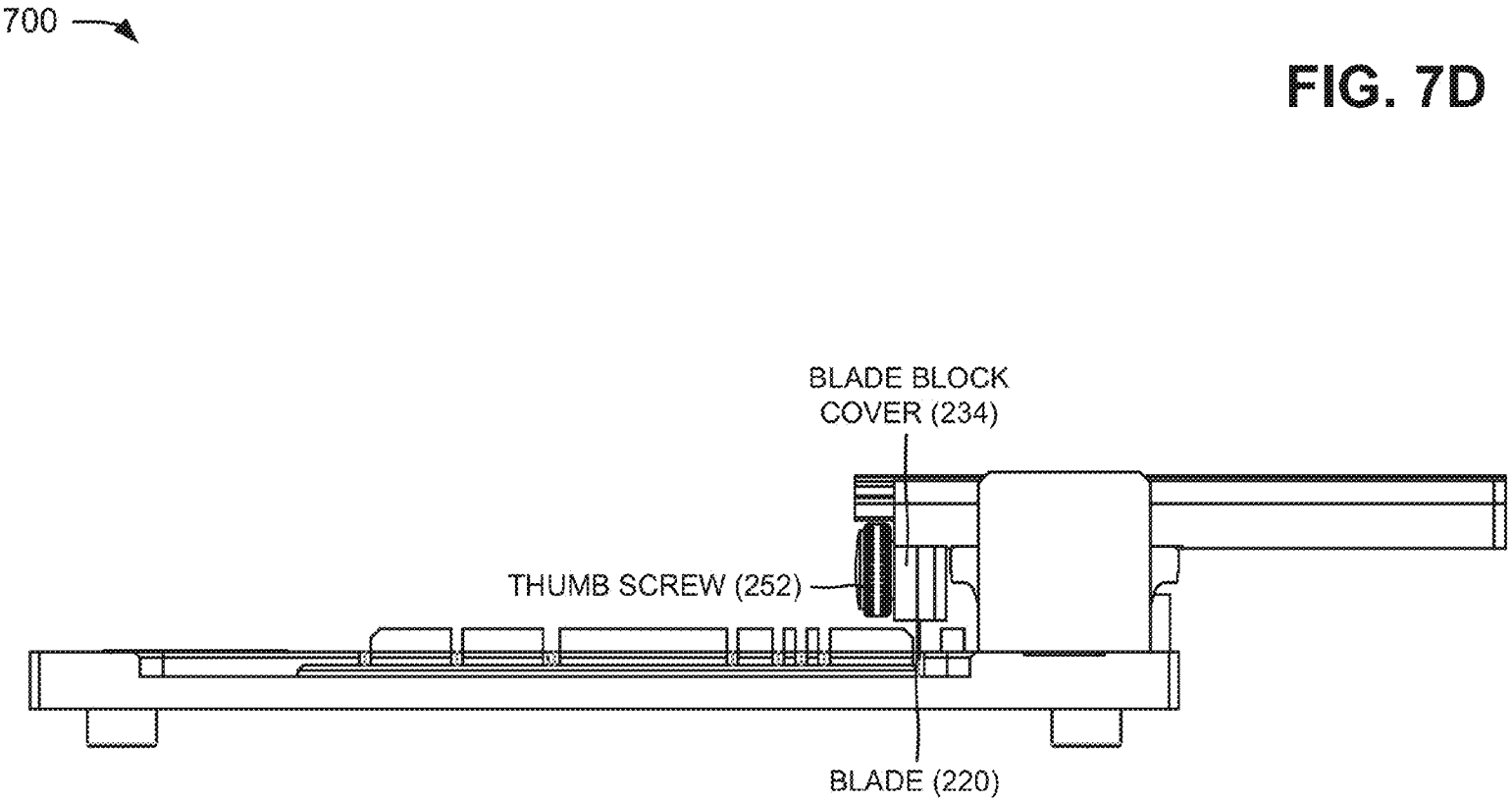

After removing the first blade 220, the user may remove adjustable plate 212 from sample cutter 200 so that the user may access the second blade 220. For example, the user may lift location knobs 218 so that they are removed from the openings of first guide plate 226 and second guide plate 228. The user may remove adjustable plate 212 from linear slide assembly 246, as shown in FIG. 7D. The user may unscrew the second thumb screw 252 associated with second blade block cover 234, and may remove second blade block cover 234 from second blade block 242.

Figure 7E:
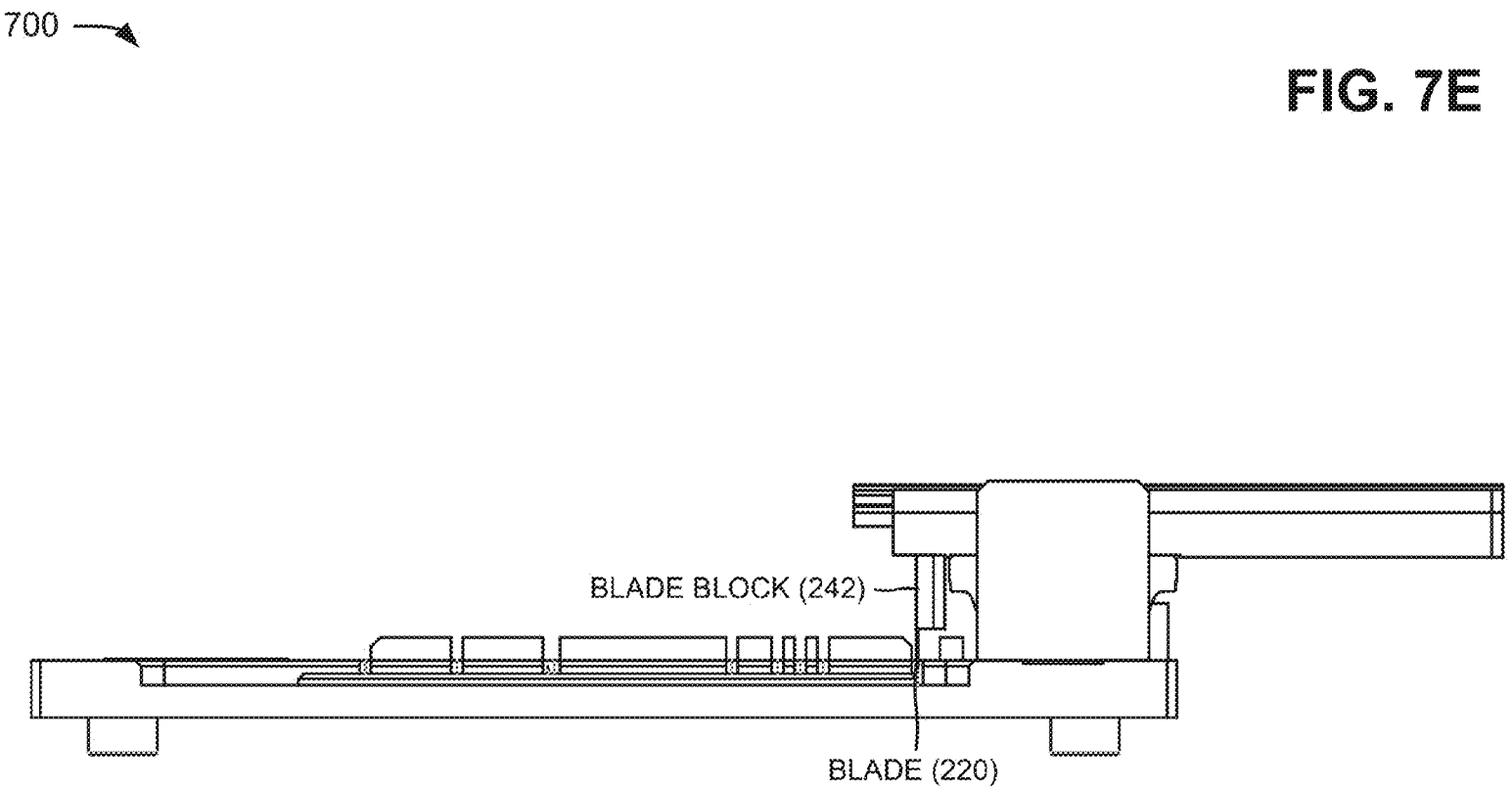
Figure 7F:
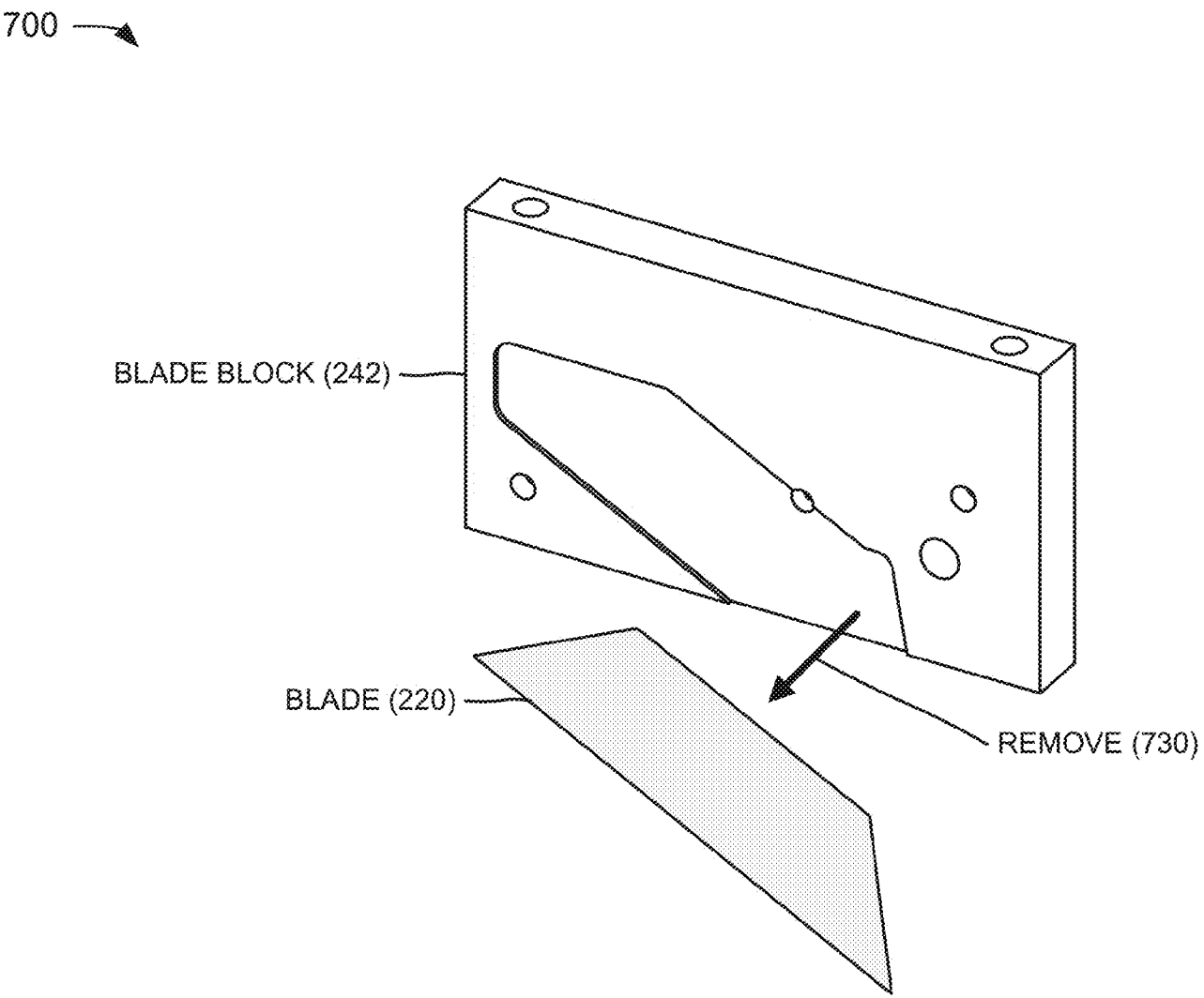

After removing second blade block cover 234, the second blade 220 may be accessible in second blade block 242, as shown in FIG. 7E. The second blade 220 may be retained in second blade block 242 via one or more magnets. The user may carefully remove the second blade 220 from second blade block 242 by exerting a force (e.g., that overcomes the force of the one or more magnets) on the second blade 220, as indicated by reference number 730 in FIG. 7E. The user may discard the second blade 220.

The user may place a new blade 220 in second blade block 242, and the one or more magnets may retain the new blade 220 in second blade block 242. The user may replace second blade block cover 234 on second blade block 242, and may tighten the second thumb screw 252 so that second blade block cover 234 and second blade block 242 are connected. The user may then replace slide adjustable plate 212 on linear slide assembly 246. The user may place another new blade 220 in first blade block 244, and the one or more magnets may retain the new blade 220 in first blade block 244. The user may replace first blade block cover 214 on first blade block 244, and may tighten the first thumb screw 252 so that first blade block cover 214 and first blade block 244 are connected. After replacing blades 220, sample cutter 200 may be ready to use once again.

As indicated above, FIGS. 7A-7F are provided merely as an example. Other examples are possible and may differ from what was described with regard to FIGS. 7A-7F.

CONCLUSION

Systems and/or methods described herein may provide a corrugated sample cutter that may cut a variety of sample sizes for a variety of tests, such as edge crush tests, pin adhesion tests, etc. The corrugated sample cutter may include an adjustable width cutting assembly with two blades positioned inside the cutting assembly. One blade may be provided in a stationary portion of the cutting assembly and the other blade may be provided in a movable portion of the cutting assembly. A user of the corrugated sample cutter may quickly and easily adjust the width of the cutting assembly so that various widths may be obtained without any mechanical tools.

The foregoing description of implementations provides illustration and description, but is not intended to be exhaustive or to limit the implementations to the precise form disclosed. Modifications and variations are possible in light of the above teachings or may be acquired from practice of the implementations.

Even though particular combinations of features are recited in the claims and/or disclosed in the specification, these combinations are not intended to limit the disclosure of the specification. In fact, many of these features may be combined in ways not specifically recited in the claims and/or disclosed in the specification. Although each dependent claim listed below may directly depend on only one other claim, the disclosure of the specification includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Where only one item is intended, the term "one" or similar language is used. Further, the phrase "based on" is intended to mean "based, at least in part, on" unless explicitly stated otherwise.

What is claimed is:

1. A sample cutter comprising:

a base plate for supporting a corrugated cardboard sample to be cut, the base plate including a plurality of grooves, the plurality of grooves including:

a particular groove, a first set of grooves spaced apart from the particular groove at a first set of widths measured in a first unit of measure, and a second set of grooves, different than the first set of grooves, and spaced apart from the particular groove at a second set of widths measured in a second unit of measure different than the first unit of measure, first widths of the first set of widths being different than second widths of the second set of widths;

a pair of guide rails connected to the base plate, the pair of guide rails enabling the corrugated cardboard sample to be positioned for cutting;

a slide rail connected to the base plate; and a cutting assembly connected to the slide rail, the cutting assembly being capable of moving along a length of the slide rail, and the cutting assembly including:

a first cutting blade, a second cutting blade that is adjustable in relation to the first cutting blade, the second cutting blade being capable of being spaced apart from the first cutting blade at the first set of widths or the second set of widths, the first cutting blade being received in the particular groove of the base plate, the second cutting blade being received in one of the plurality of grooves of the base plate, other than the particular groove, in accordance with a selected width of the first set of widths or the second set of widths, and the first cutting blade and the second cutting blade cutting the corrugated cardboard sample in accordance with the selected width, a first plate connected to the first cutting blade and being capable of moving along the length of the slide rail, the first plate including:

a first set of openings spaced apart at the first set of widths, and a second set of openings spaced apart at the second set of widths, a second plate connected to the second cutting blade and being adjustable in relation to the first plate, the second plate including a first opening and a second opening, a first location knob provided through the first opening of the second plate and being received in one of the first set of openings of the first plate, the first location knob enabling the second cutting blade to be spaced apart from the first cutting blade in accordance with the first set of widths, and a second location knob provided through the second opening of the second plate and being received in one of the second set of openings of the first plate, the second location knob enabling the second cutting blade to be spaced apart from the first cutting blade in accordance with the second set of widths.

2. The sample cutter of claim 1, where the first cutting blade and the second cutting blade connect to the cutting assembly via thumbscrews.

3. The sample cutter of claim 1, where the cutting assembly includes:

a carriage connected to the slide rail and capable of moving along a length of the slide rail, the first plate and the second plate being connected to the carriage.

4. The sample cutter of claim 3, where the carriage communicates with a linear ball slide of the slide rail that enables the carriage to move along the length of the slide rail.

5. The sample cutter of claim 3, further comprising:

a grab catch block connected to the base plate, the grab catch block preventing the carriage from moving past an end of the slide rail.

6. The sample cutter of claim 5, where:

the carriage includes a grab catch clip, the grab catch block includes a grab catch roller for receiving and retaining the grab catch clip, and the grab catch roller locks the cutting assembly against the grab catch block when the grab catch clip is retained in the grab catch roller.

7. A cutting assembly for a sample cutter that includes a base plate for supporting a corrugated cardboard sample to be cut, and a slide rail connected to base plate, the base plate including a plurality of grooves that include a particular groove, a first set of grooves spaced apart from the particular groove at a first set of widths measured in a first unit of measure, and a second set of grooves, different than the first set of grooves, and spaced apart from the particular groove at a second set of widths measured in a second unit of measure different than the first unit of measure, first widths of the first set of widths being different than second widths of the second set of widths, the cutting assembly comprising:

a carriage connected to the slide rail, the carriage being capable of moving along a length of the slide rail;

a first cutting blade;

a second cutting blade that is adjustable in relation to the first cutting blade, the second cutting blade being capable of being spaced apart from the first cutting blade at the first set of widths or the second set of widths, the first cutting blade being received in the particular groove of the base plate, the second cutting blade being received in one of the plurality of grooves of the base plate, other than the particular groove, in accordance with a selected width of the first set of widths or the second set of widths, and the first cutting blade and the second cutting blade cutting the corrugated cardboard sample in accordance with the selected width;

a first plate connected to the first cutting blade and being capable of moving along the length of the slide rail, the first plate being connected to the carriage and including:

a first set of openings spaced apart at the first set of widths, and a second set of openings spaced apart at the second set of widths;

a second plate connected to the second cutting blade and being adjustable in relation to the first plate, the second plate being connected to the carriage including a first opening and a second opening;

a first location knob provided through the first opening of the second plate and being received in one of the first set of openings of the first plate, the first location knob enabling the second cutting blade to be spaced apart from the first cutting blade in accordance with the first set of widths; and a second location knob provided through the second opening of the second plate and being received in one of the second set of openings of the first plate, the second location knob enabling the second cutting blade to be spaced apart from the first cutting blade in accordance with the second set of widths.

8. The cutting assembly of claim 7, where the first cutting blade and the second cutting blade connect to the cutting assembly via thumbscrews.

9. The cutting assembly of claim 7, where the second plate is adjustable to the first plate in a direction perpendicular to an orientation of the slide rail.

10. The cutting assembly of claim 7, where the carriage communicates with a linear ball slide of the slide rail that enables the carriage to move along the length of the slide rail.

11. The cutting assembly of claim 7, where a grab catch block is connected to the base plate and prevents the carriage from moving past an end of the slide rail.

12. The cutting assembly of claim 11, where:

the carriage includes a grab catch clip, the grab catch block includes a grab catch roller for receiving and retaining the grab catch clip, and the grab catch roller locks the cutting assembly against the grab catch block when the grab catch clip is retained in the grab catch roller.

13. The cutting assembly of claim 7, where a pair of guide rails are connected to the base plate and enable the corrugated cardboard sample to be positioned for cutting.

14. The cutting assembly of claim 13, where the pair of guide rails are perpendicular to each other.

15. The sample cutter of claim 2, where the first cutting blade and the second cutting blade are manually removable and replaceable from the sample cutter via the thumbscrews.

16. The sample cutter of claim 1, further comprising:

an anti-slip material provided on a portion of a base plate, the anti-slip material preventing the corrugated cardboard sample from slipping when the corrugated cardboard sample is cut by the sample cutter.

17. The sample cutter of claim 1, further comprising:

a plurality of rubber feet, each of the plurality of rubber feet supporting the base plate and preventing the base plate from sliding on a surface on which the sample cutter is placed, and each of the plurality of rubber feet being located at or near a corner of a bottom surface of the base plate.

18. The cutting assembly of claim 7, further comprising:

a bumper provided at an end of the slide rail, the bumper preventing the carriage from moving past the end of the slide rail.

19. The cutting assembly of claim 7, where the carriage and the cutting assembly move along the length of the slide rail and between a grab catch block and a bumper.

20. The cutting assembly of claim 7, where an anti-slip material is provided on a portion of a base plate, and the anti-slip material prevents the corrugated cardboard sample from slipping when the corrugated cardboard sample is cut.

21. The cutting assembly of claim 7, where a bumper is provided at an end of the slide rail, and the bumper prevents the carriage from moving past the end of the slide rail.

* * * * *